US012653366B2

(12) United States Patent
Royale et al.

(10) Patent No.: US 12,653,366 B2
(45) Date of Patent: Jun. 16, 2026

(54) EXTRACTION CLEANER

(71) Applicant: BISSELL Inc., Grand Rapids, MI (US)

(72) Inventors: Victoria J. Royale, Comstock Park, MI (US); Mitchell P. Sloboda, Sparta, MI (US)

(73) Assignee: BISSELL Inc., Grand Rapids, MI (US)

( * ) Notice: Subject to any disclaimer, the term of this patent is extended or adjusted under 35 U.S.C. 154(b) by 199 days.

(21) Appl. No.: 18/347,677

(22) Filed: Jul. 6, 2023

(65) Prior Publication Data

US 2024/0008706 A1 Jan. 11, 2024

Related U.S. Application Data

(60) Provisional application No. 63/367,740, filed on Jul. 6, 2022.

(51) Int. Cl.
*A47L 11/40* (2006.01)
*A47L 11/30* (2006.01)
*A47L 11/34* (2006.01)

(52) U.S. Cl.
CPC ..... *A47L 11/4075* (2013.01); *A47L 11/30* (2013.01); *A47L 11/34* (2013.01); *A47L 11/4016* (2013.01); *A47L 11/4025* (2013.01); *A47L 11/4083* (2013.01); *A47L 11/4088* (2013.01)

(58) Field of Classification Search
CPC ..... A47L 11/4083; A47L 11/4016; A47L 11/4088; A47L 11/4075; A47L 11/40; A47L 11/4013; A47L 11/4025; A47L 11/408; A47L 11/4094; A47L 11/30; A47L 11/34; A47L 7/0023; A47L 7/0028
See application file for complete search history.

(56) References Cited

U.S. PATENT DOCUMENTS 4,547,927 A 10/1985 Berfield
4,566,149 A 1/1986 Fitzwater
4,676,287 A 6/1987 Fitzwater
5,237,720 A * 8/1993 Blase ..... A47L 11/4044 15/321
5,301,386 A 4/1994 Thomas et al.
5,459,901 A 10/1995 Blase et al.
(Continued)

FOREIGN PATENT DOCUMENTS

CN 108348125 A 7/2018
CN 108937747 A 12/2018
(Continued)

*Primary Examiner* — David S Posigian
*Assistant Examiner* — Steven Huang
(74) *Attorney, Agent, or Firm* — Price Heneveld LLP

(57) ABSTRACT

An extraction cleaner includes a base, a supply tank assembly, and a recovery tank assembly. The base has a housing with a supply tank seat adjacent to a first side wall and a recovery tank seat adjacent to an opposite second side wall. The base has a handle extending from the first and second side walls and above the housing. The supply tank assembly is received by the supply tank seat, with an inner wall interfitting with the first side wall and with a first leg portion of the handle and extending along the first leg portion to a grip portion. The recovery tank assembly is received by the recovery tank seat, with an inner wall interfitting with the second side wall and with a second leg portion of the handle and extending along the second leg portion to the grip portion.

19 Claims, 17 Drawing Sheets

(56) References Cited

U.S. PATENT DOCUMENTS

| | | | | |
|---|---|---|---|---|
| 5,836,046 | A | 11/1998 | Huffman et al. | |
| 6,375,696 | B2 | 4/2002 | Wegelin et al. | |
| 6,385,810 | B1 | 5/2002 | Lang | |
| 6,588,055 | B2 | 7/2003 | Bair et al. | |
| 6,725,498 | B2 | 4/2004 | Symensma et al. | |
| 7,073,226 | B1 * | 7/2006 | Lenkiewicz | A47L 11/4083 15/327.2 |
| 7,222,389 | B2 | 5/2007 | Morgan et al. | |
| 7,325,274 | B2 | 2/2008 | Jeong | |
| 7,555,813 | B2 | 7/2009 | Choi | |
| 7,870,637 | B2 | 1/2011 | Parr et al. | |
| 8,505,155 | B2 | 8/2013 | Lenkiewicz | |
| 8,640,301 | B1 | 2/2014 | Lee et al. | |
| 11,089,933 | B2 | 8/2021 | Xia et al. | |
| 11,096,544 | B2 | 8/2021 | Nguyen et al. | |
| 11,129,512 | B2 | 9/2021 | Weigel et al. | |
| 11,259,679 | B2 | 3/2022 | Royale | |
| 2007/0067945 | A1 * | 3/2007 | Kasper | A47L 9/165 15/328 |
| 2009/0205163 | A1 | 8/2009 | Linhart et al. | |
| 2013/0318741 | A1 * | 12/2013 | Moyher, Jr. | A47L 11/4083 15/327.1 |
| 2016/0367100 | A1 | 12/2016 | Tran et al. | |
| 2017/0127900 | A1 | 5/2017 | Wright et al. | |
| 2019/0082905 | A1 * | 3/2019 | Chavana, Jr. | A47L 9/2857 |
| 2019/0269291 | A1 * | 9/2019 | Royale | A47L 7/0009 |
| 2020/0093344 | A1 * | 3/2020 | Quintero | A47L 11/4005 |
| 2021/0030248 | A1 | 2/2021 | Ko et al. | |
| 2021/0030249 | A1 | 2/2021 | Ko et al. | |
| 2021/0330159 | A1 | 10/2021 | Rukavina | |
| 2022/0296057 | A1 * | 9/2022 | Gray | A47L 11/4036 |
| 2024/0206695 | A1 * | 6/2024 | Dawson | A47L 11/4002 |

FOREIGN PATENT DOCUMENTS

| | | | | |
|---|---|---|---|---|
| CN | 214160679 | U | 9/2021 | |
| CN | 215838794 | U | 2/2022 | |
| EP | 0174312 | B1 | 9/1991 | |
| EP | 1153815 | A2 | 11/2001 | |
| EP | 1438918 | B1 | 3/2011 | |
| EP | 2558224 | B1 | 10/2014 | |
| WO | WO-2022119817 | A1 * | 6/2022 | A47L 11/4075 |
| WO | 2023099908 | A1 | 6/2023 | |

* cited by examiner

EXTRACTION CLEANER

CROSS-REFERENCE TO RELATED APPLICATION

This application claims priority to and the benefit under 35 U.S.C. § 119(e) of U.S. Provisional Application No. 63/367,740, filed on Jul. 6, 2022, entitled EXTRACTION CLEANER, the disclosure of which is hereby incorporated herein by reference in its entirety.

TECHNICAL FIELD

The present disclosure generally relates to an extraction cleaner for cleaning a surface.

BACKGROUND

Extraction cleaners are utilized for cleaning carpets, upholstery, furniture, and other surfaces. Extraction cleaners extract dirt from a surface using both a vacuum system to suction debris and/or fluid from a surface and a fluid delivery system. The fluid delivery system supplies cleaning fluid, such as water, cleaning solution, or a mixture of both, to the surface to be cleaned from a supply tank onboard the extraction cleaner. The recovery system utilizes an onboard suction source that recovers the fluid applied by the fluid delivery system along with dirt and debris, typically drawing the recovered dirt and fluid through a nozzle of a cleaning tool, through a hose fluidly coupled to the suction source, and into a recovery storage tank that is also onboard the extraction cleaner.

BRIEF SUMMARY

An extraction cleaner is provided with multiple features enabling a compact design to promote portability while enabling a relatively large capacity supply tank and recovery tank that are secured to a base yet conveniently removable therefrom. The structure of a carrying handle of the extraction cleaner may be utilized in order to permit the supply and recovery tanks to be taller, and therefore provide needed tank volume without expanding a width of the base. The extraction cleaner may be, but is not limited to, a cordless portable extraction cleaner.

An extraction cleaner within the scope of the disclosure may include a base, a supply tank assembly, and a recovery tank assembly. The base may include a housing that has a first side wall and a second side wall opposite from the first side wall. The base may have a supply tank seat adjacent to the first side wall and a recovery tank seat adjacent to the second side wall. The base may have a handle extending from the first side wall and the second side wall and above the housing. The handle may include a grip portion, a first leg portion extending from the first side wall to the grip portion, and a second leg portion extending from the second side wall to the grip portion. The supply tank assembly may be configured to be received by the supply tank seat, with an inner wall of the supply tank assembly interfitting with the first side wall of the housing and with the first leg portion of the handle and extending along the first leg portion to the grip portion. The recovery tank assembly may be configured to be received by the recovery tank seat, with an inner wall of the recovery tank assembly interfitting with the second side wall of the housing and with the second leg portion of the handle and extending along the second leg portion to the grip portion. With this configuration, the handle is used to support the recovery tank assembly and supply tank assembly along a greater extent of the handle's height than existing extraction cleaners, allowing the tanks to also have a greater height and without needing to expand the width of the tanks or the housing to achieve desired tank volumes.

An extraction cleaner within the scope of the disclosure may include a base that has a housing, a supply tank assembly, and a recovery tank assembly. The housing may have a first side wall and a second side wall opposite from the first side wall, a supply tank seat adjacent to the first side wall, a recovery tank seat adjacent to the second side wall, and a handle extending from the first side wall and the second side wall and above the housing. The supply tank assembly may be configured to be received by the supply tank seat, with an inner wall of the supply tank assembly interfit with the first side wall of the housing and with the handle. The recovery tank assembly may include a recovery tank configured to be received by the recovery tank seat, with an inner wall of the recovery tank assembly interfit with the first side wall of the housing and with the handle. The recovery tank assembly may include a recovery tank lid on the recovery tank opposite from the recovery tank seat. In an implementation, the handle does not extend laterally outward over the recovery tank lid. A latching assembly may be operable to engage a feature at an inner wall of the recovery tank assembly to latch the recovery tank assembly to the base when the inner wall of the recovery tank assembly is interfit with the second side wall. For example, the base may have a notch, such as at the handle, and the latching assembly may include a spring-biased latch at the notch. The feature at the inner wall of the recovery tank assembly may be a projection that extends into the notch and is engaged by the spring-biased latch when the inner wall of the recovery tank assembly is interfit with the second side wall of the housing and with the handle. In an embodiment in which the notch is at the handle, the recovery tank assembly is secured near its upper extent, which may lend stability to the extraction cleaner when in use.

Additionally, a suction hose and a liquid delivery line may be securable to the base via a mount that may have features to limit rocking and/or twisting of the suction hose relative to the base during use. For example, an extraction cleaner within the scope of the disclosure may include a base that has a housing. A suction source may be within the housing and may be operable to generate a working air stream. A fluid pump may also be within the housing. The extraction cleaner may include a first coupling for fluid communication with the fluid pump and a second coupling for fluid communication with the suction source. The first coupling and the second coupling may be disposed adjacent to one another on the base. The extraction cleaner may include a suction hose having an inlet through which the working air stream is drawn through the suction hose and having an outlet configured to couple to the second coupling. A mount may be supported on and may surround at least a portion of an outer wall of the suction hose adjacent to the outlet and at an opening in the outer wall. A fluid delivery line may be configured to couple to the first coupling and may be routed through the mount and through the opening in the outer wall of the suction hose such that the fluid delivery line has a first portion extending through the mount to the opening and a second portion internal to the suction hose and extending between the opening and the inlet of the suction hose. The fluid delivery line is thus spaced apart from the outlet of the suction hose so as not to block or reduce flow at the outlet. The mount helps to ensure that the suction hose and the fluid delivery line extending through the suction hose remain coupled to the base. The suction hose and fluid delivery line are conveniently removable in unison by the customer by removing the mount from the base.

Despite the spatial limitations of a compact, portable extraction cleaner, a battery pack may be located within the housing, and the housing may be configured to promote cooling of the battery pack. For example, an extraction cleaner may include a base having a housing defining an internal cavity and having a first side wall, a second side wall opposite from the first side wall, a supply tank seat adjacent to the first side wall, a recovery tank seat adjacent to the second side wall, and a handle extending from the first side wall and the second side wall above a top wall of the housing. The extraction cleaner may include a motor and impeller assembly disposed within the internal cavity between the recovery tank seat and the supply tank seat and operable to generate a working air stream. The extraction cleaner may also include a battery pack disposed within the housing above the motor and impeller assembly, and a cooling fan disposed within the housing between the battery pack and the motor and impeller assembly and driven by the motor and impeller assembly. The internal cavity may include a cooling space extending around the battery pack and between the battery pack and the housing. The housing may have an air inlet adjacent to the battery pack through which ambient air is drawn into the cooling space by the cooling fan. Stated differently, the housing and the air inlet are configured to promote cooling of the battery pack. In an implementation, the extraction cleaner may include a printed circuit board assembly within the housing above the battery pack and under the top wall of the housing.

These and other features, advantages, and objects of the present disclosure will be further understood and appreciated by those skilled in the art by reference to the following specification, claims, and appended drawings.

BRIEF DESCRIPTION OF THE DRAWINGS

The drawings described herein are for illustrative purposes only, are schematic in nature, and are intended to be exemplary rather than to limit the scope of the disclosure.

Figure 1:
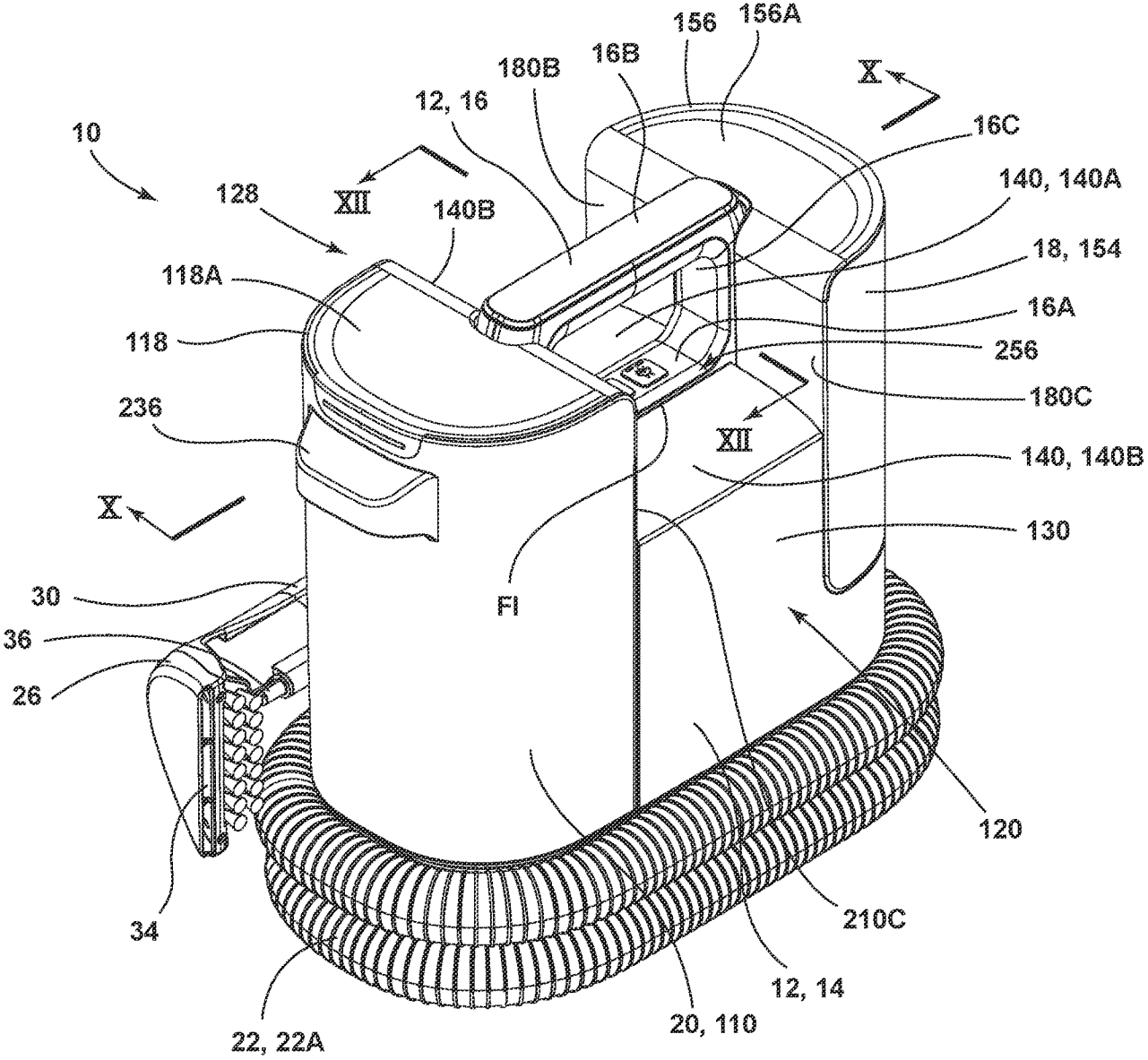
FIG. 1 is a front perspective view of an extraction cleaner that has a base with a housing and a handle, a supply tank assembly, a recovery tank assembly, and a suction hose wrapped around the housing and having an accessory tool in communication with an inlet of the suction hose, according to the present disclosure.

The above features and advantages and other features and advantages of the present teachings are readily apparent from the following detailed description of the modes for carrying out the present teachings when taken in connection with the accompanying drawings. It should be understood that even though in the following Figures embodiments may be separately described, single features thereof may be combined into additional embodiments.

DETAILED DESCRIPTION

The present illustrated embodiments reside primarily in combinations of method steps and apparatus components related to an extraction cleaner. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

With reference to FIGS. 1-18, the present disclosure generally relates to an extraction cleaner 10 and various aspects thereof for improved performance, compactness, ease of use, and other benefits. The extraction cleaner 10 includes a base 12 that has a housing 14, with a notched region formed by a laterally extending portion 14A and a vertically extending side portion 14B for selectively receiving components, and a handle 16 extending upward from the housing 14. The handle 16 includes a bottom portion 16A, a grip portion 16B, a first leg portion 16C extending between the bottom portion 16A and the grip portion 16B, and a second leg portion 16D extending between the bottom portion 16A and the grip portion 16B. As further discussed herein, a supply tank assembly 18 and a recovery tank assembly 20 are both seated on the base 12 and interfit and mated with both the housing 14 and the handle 16. A suction hose 22, which includes a flexible hose portion 22A and a hose fitting 22B, is shown wrapped around a lower skirt 24 (see FIG. 2) of the base 12.

Figure 2:
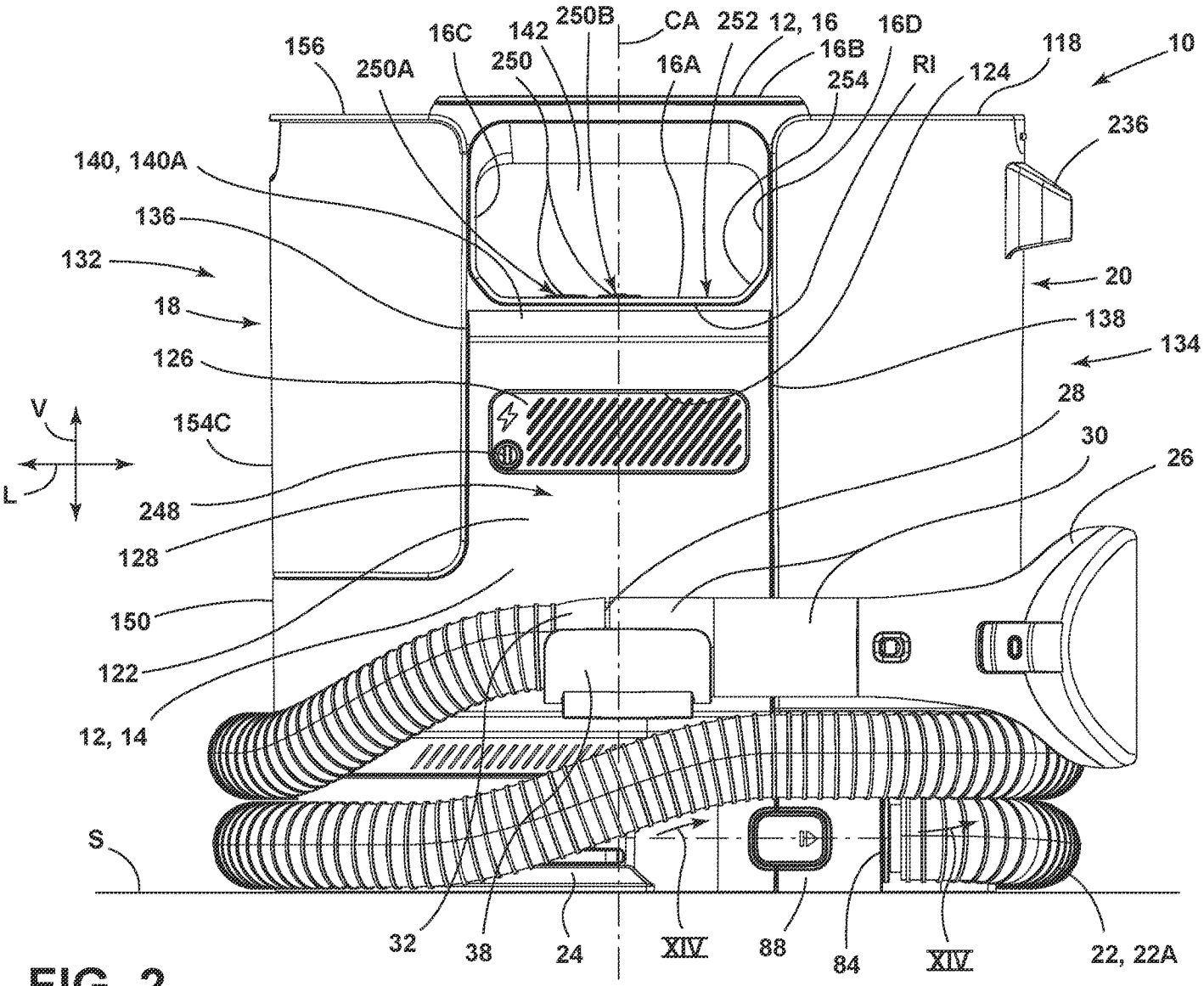
FIG. 2 is a rear elevational view of an extraction cleaner with a base, a supply tank assembly, a recovery tank assembly, and a suction hose, according to the present disclosure.

With reference to FIGS. 1 and 2, a cleaning tool 26 is in fluid communication with an inlet 28 of the suction hose 22 when secured to a wand 30 connected to a hose connector 32 at the inlet 28. The cleaning tool 26 includes a suction nozzle 34 and agitators (see FIG. 1), such as, but not limited to, bristles. A spray nozzle 36 is disposed on an underside of the cleaning tool 26 for selectively dispensing cleaning fluid on the surface S to be cleaned (e.g., by depression of a trigger that may be disposed on an underside of the wand 30). A retainer 38 (see FIGS. 2 and 12) supports the wand 30 when the cleaning tool 26 is not in use.

The housing 14 defines an internal cavity 40 (shown in FIGS. 10 and 12) divided into a lower cavity portion 40A and an upper cavity portion 40B by internal walls 42 that serve as a motor housing. The lower cavity portion 40A houses a suction source 44, such as a motor and impeller assembly 46, 48, positioned therein, including a suction motor 46 and an impeller 48. The upper cavity portion 40B houses a battery pack 56, including one or more battery cells 56A and a battery cover 56B, and a printed circuit board assembly (PCBA) 58 discussed herein. The motor and impeller assembly 46, 48 is disposed in the internal cavity 40 between a supply tank seat 80 and a recovery tank seat 82 (see FIG. 6) and discussed herein.

Referring to FIGS. 1 and 2, an outlet 84 of the suction hose 22 is in fluid communication with the suction source 44 and with the recovery tank assembly 20 via one or more conduits 86 disposed in the internal cavity 40 (see FIG. 10), and is retained to the base 12 with improved stability via a mount 88 that has an inner mount portion 88A and an outer mount portion 88B that defines an opening 88C, as further discussed herein. The suction source 44 is in fluid communication with the suction nozzle 34 of the cleaning tool 26 through the conduits 86, the suction hose 22, and the wand 30, for generating a working air stream, and the recovery tank assembly 20 separates and collects fluid and debris from the working airstream for later disposal.

The supply tank assembly 18 is in fluid communication with the spray nozzle 36 of the cleaning tool 26 via a fluid delivery line 104. The fluid delivery line 104 includes an end 104A proximate to the base 12, a first portion 104B extending through the mount 88, and a second portion 104C that extends internally within the suction hose 22 (see, e.g., FIGS. 10 and 14) and through which pressurized fluid is delivered from the supply tank assembly 18 via a fluid pump 106 disposed in the internal cavity 40. The fluid pump 106 is in fluid communication with the supply tank assembly 18 via a fluid line 108 (shown in cross-section in FIG. 10).

During operation, the extraction cleaner 10 draws in the fluid and debris-laden working airstream through the suction nozzle 34 and into a recovery tank 110 of the downstream recovery tank assembly 20. The recovery tank 110 includes a lower wall portion 110A extending from a bottom wall 110B and an exterior wall 110C extending from the lower wall portion 110A to a top 110D of the recovery tank 110. In the recovery tank 110, the fluid and debris are substantially separated from the working airstream. The working airstream then exits the recovery tank assembly 20 and passes through the motor and impeller assembly 46, 48 prior to being exhausted from the extraction cleaner 10. The recovery tank 110 can be periodically emptied of collected fluid and debris by removing the recovery tank assembly 20 from the base 12 as discussed herein and removing a lid 118 having a top 118A of the recovery tank assembly 20.

In FIGS. 1 and 2, the supply tank assembly 18 and the recovery tank assembly 20 are shown seated on the base 12, and the suction hose 22 is shown wrapped around the base 12. The suction hose 22 would be unwound from the base 12 and the suction nozzle 34 of the cleaning tool 26 placed adjacent to the surface S shown in FIG. 2 for use in cleaning the surface S. The surface S may be, for example, any type of flooring, including soft surfaces, such as carpet and rugs, upholstered furniture, and hard surfaces, such as tile, wood, vinyl, and laminate surfaces. However, the aspects disclosed herein may be implemented on other types and configurations of cleaners within the scope of the disclosure.

Figure 3:
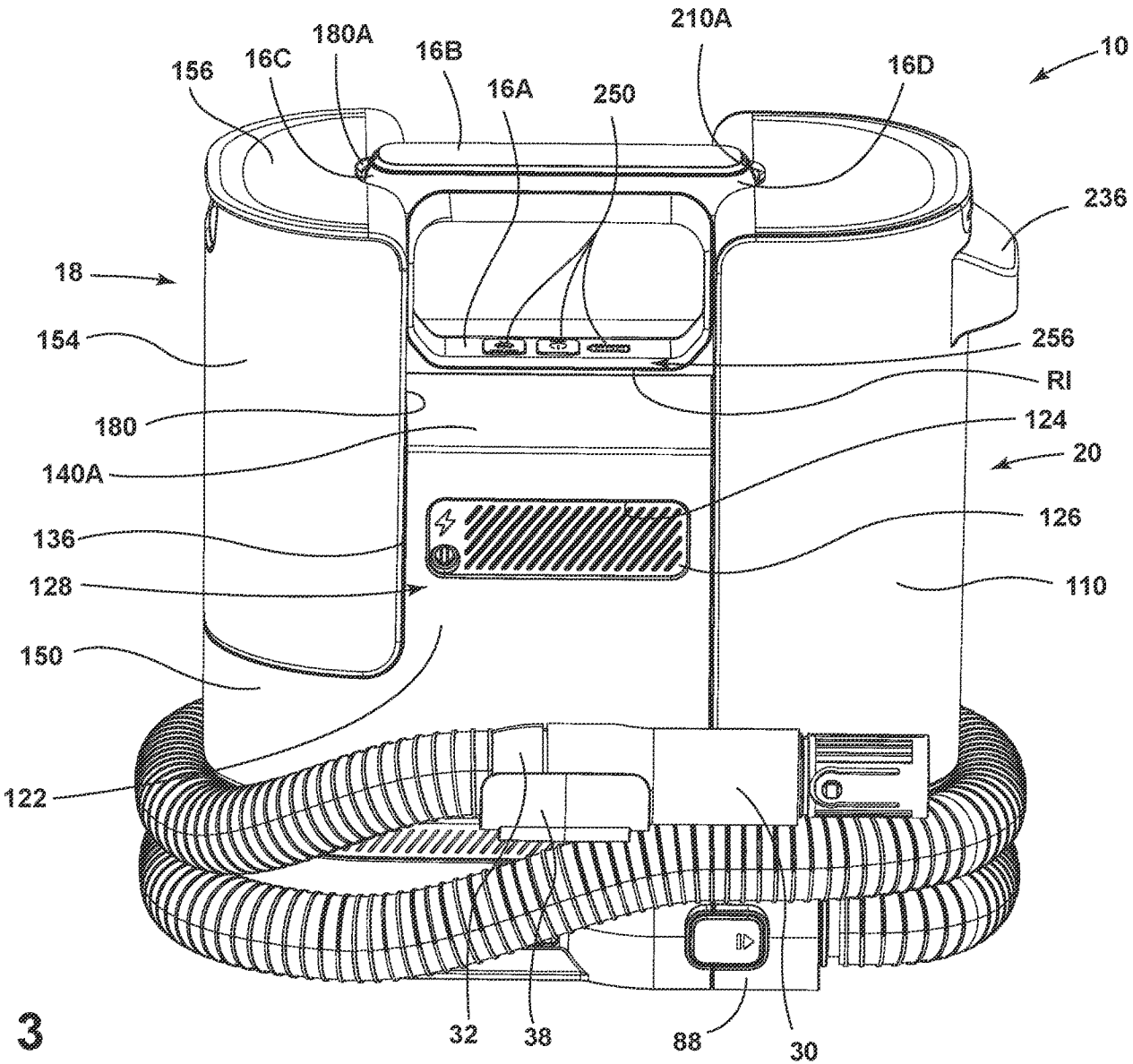
FIG. 3 is a rear perspective view of an extraction cleaner with a suction hose and an accessory tool removed from the suction hose, according to the present disclosure.
Figure 4:
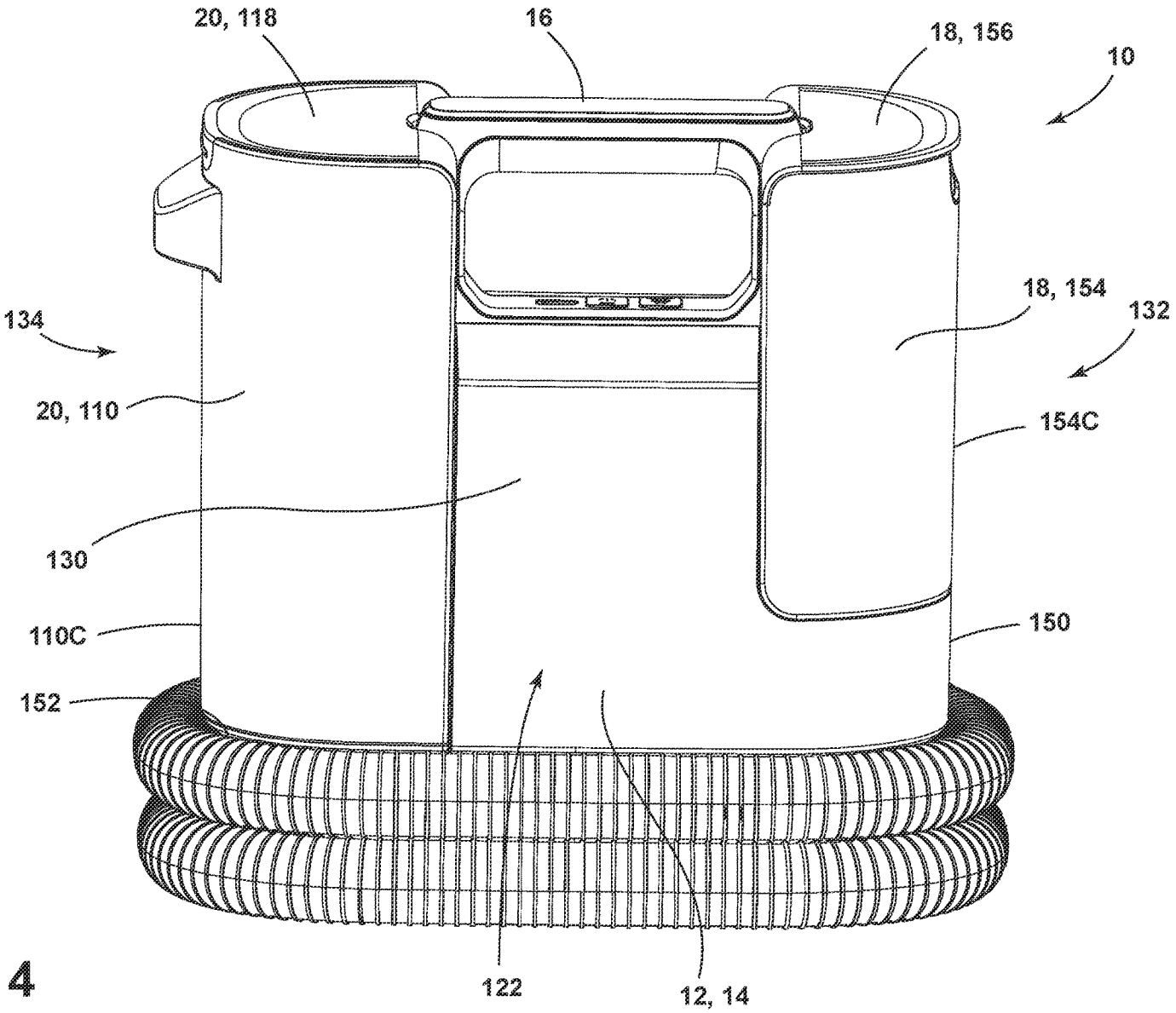
FIG. 4 is a front perspective view of an extraction cleaner, according to the present disclosure.

With reference to FIGS. 3 and 4, for purposes of description related to the figures, the terms "upper," "lower," "right," "left," "rear," "front," "vertical," "horizontal," "inner," "outer," and derivatives thereof shall relate to the extraction cleaner 10 as oriented in FIG. 4 from the perspective of a user in front of the extraction cleaner 10 (e.g., facing the extraction cleaner 10 in FIG. 4), which defines the front 120 of the extraction cleaner 10. A rear wall 122 of the housing 14 is at the rear 128 of the extraction cleaner 10 and has an air inlet 124 shown partially covered by an inlet grill 126. Ambient air is drawn in through the air inlet 124 for cooling the battery pack 56 (shown in FIGS. 10 and 12), as discussed further herein.

The front 120 of the extraction cleaner 10 is opposite from the rear 128. It should be appreciated that the front 120 and the rear 128 are defined as such for purposes of discussion only. A front wall 130 of the housing 14 is shown at the front 120. The rear wall 122 extends parallel with the front wall 130. A first side 132 of the extraction cleaner 10 is on the right side in FIG. 4, and a second side 134 of the extraction cleaner 10 is on the left side in FIG. 4. A vertical axis V in FIG. 2 indicates an upward direction (upward arrowhead) and a downward direction (downward arrowhead). A lateral axis L indicates a laterally-outward direction (the arrowhead to the left on the lateral axis L, also referred to as outward), and a laterally-inward direction (the arrowhead to the right on the lateral axis L, also referred to as inward). An inner or internal component or surface will be closer to a vertical center axis CA of the extraction cleaner 10 along the lateral axis L (or along a horizontal axis that is perpendicular to the lateral axis L) than will an outer or external component or surface.

Figure 6:
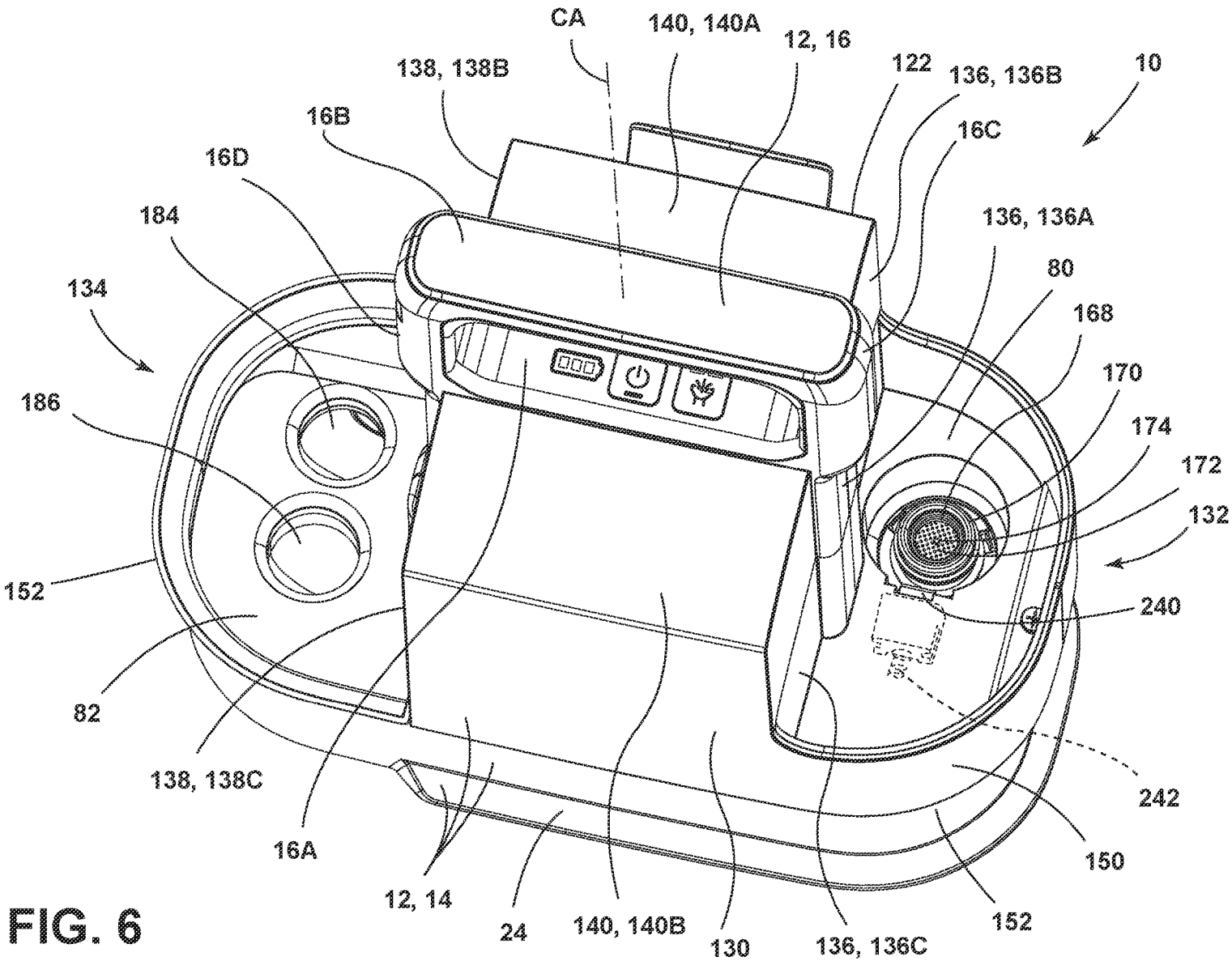
FIG. 6 is a top perspective view of an extraction cleaner with a base, showing a supply tank seat and a recovery tank seat of the base, and where a supply tank assembly, a recovery tank assembly, a suction hose, and an accessory tool are removed, according to the present disclosure.

The housing 14 includes a first side wall 136 that extends from the front wall 130 to the rear wall 122 and is at the first side 132 relative to the center axis CA (see, e.g., FIGS. 2 and 6). The first side wall 136 includes a protruding vertical column 136A between a rear planar portion 136B and a front planar portion 136C. The housing 14 also includes a second side wall 138 that also extends from the front wall 130 to the rear wall 122 and is closer to the second side 134 relative to the center axis CA (see, e.g., FIG. 6). The second side wall 138 includes a protruding vertical column 138A between a rear planar portion 138B and a front planar portion 138C.

Figure 9:
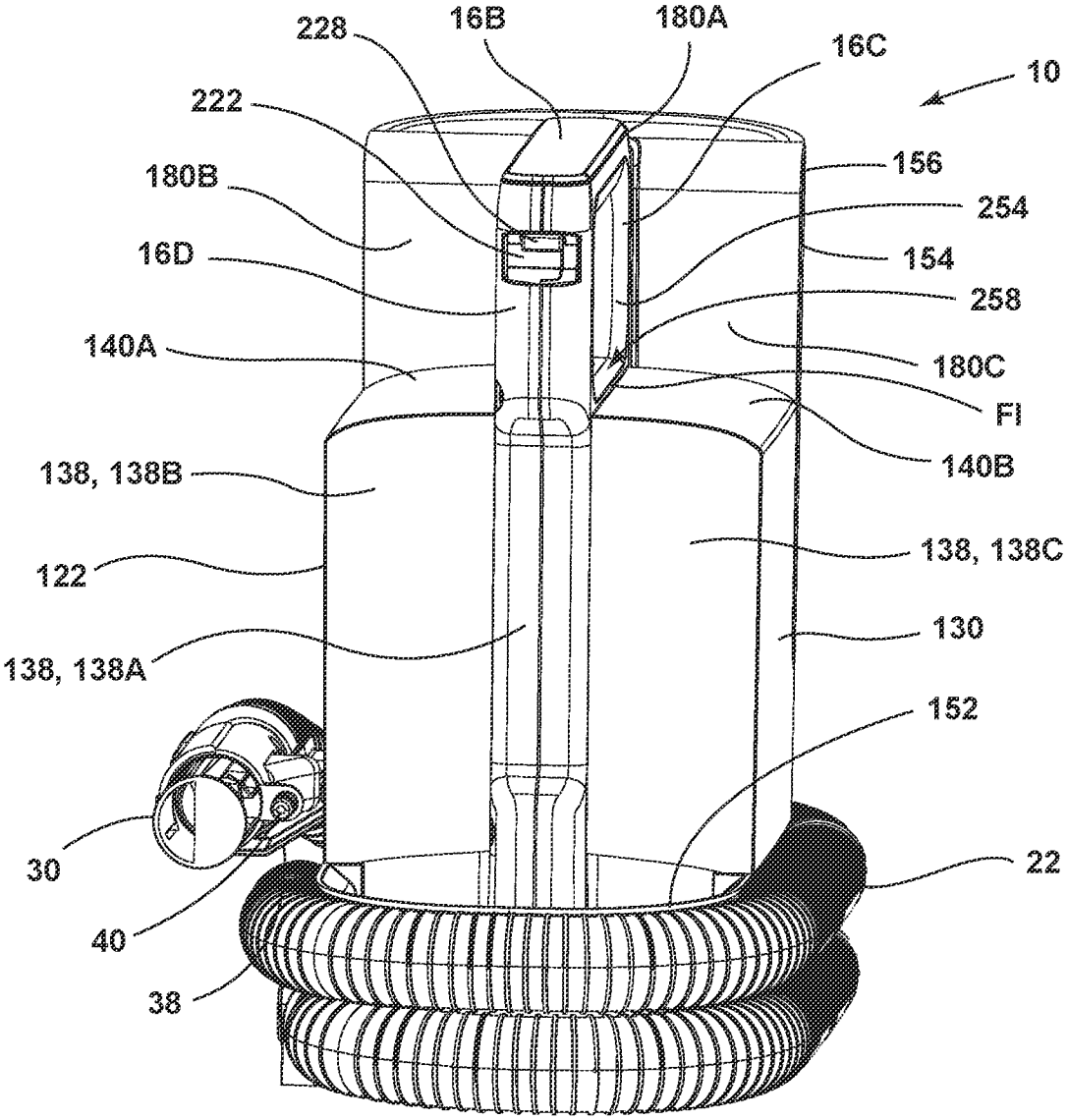
FIG. 9 is a side perspective view of an extraction cleaner with a base having a handle, showing a spring-biased latch in a notch of the handle, and where a recovery tank assembly and an accessory tool are removed, according to the present disclosure.
Figure 12:
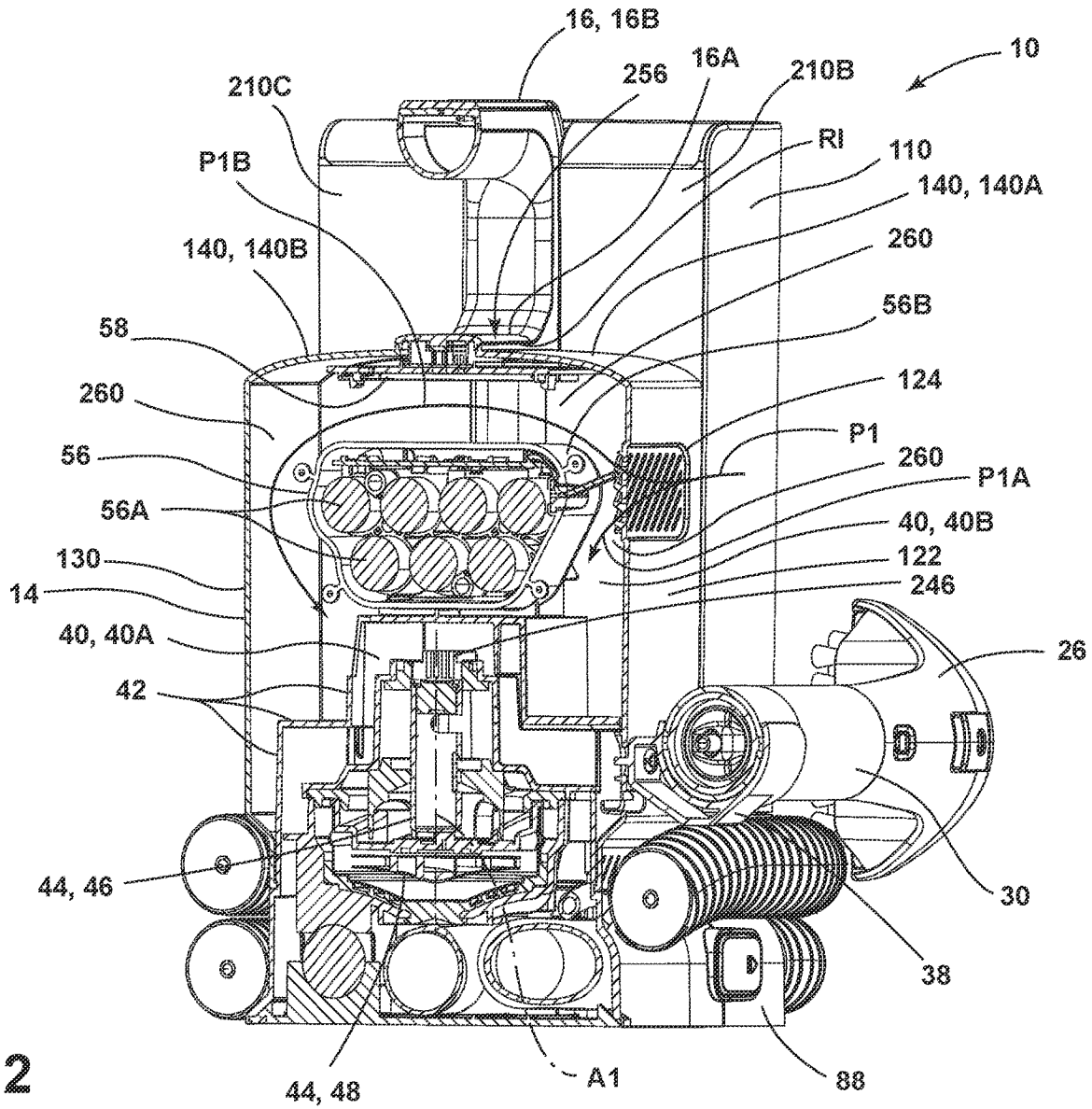
FIG. 12 is a cross-sectional view of the extraction cleaner of FIG. 1, taken at line XII-XII, according to the present disclosure.

A top wall 140 of the housing 14 includes a rear top wall portion 140A that extends forward from the rear wall 122 between the first side wall 136 and the second side wall 138 to the bottom portion 16A of the handle 16 as best shown in FIGS. 2 and 9. The top wall 140 of the housing 14 also includes a front top wall portion 140B that extends rearward from the front wall 130 between the first side wall 136 and the second side wall 138 to the bottom portion 16A of the handle 16 as shown in FIG. 9. The top wall 140 and the bottom portion 16A of the handle 16 extend over the upper cavity portion 40B of the internal cavity 40, as shown in FIG. 12. The handle 16 extends above the top wall 140.

Figure 5:
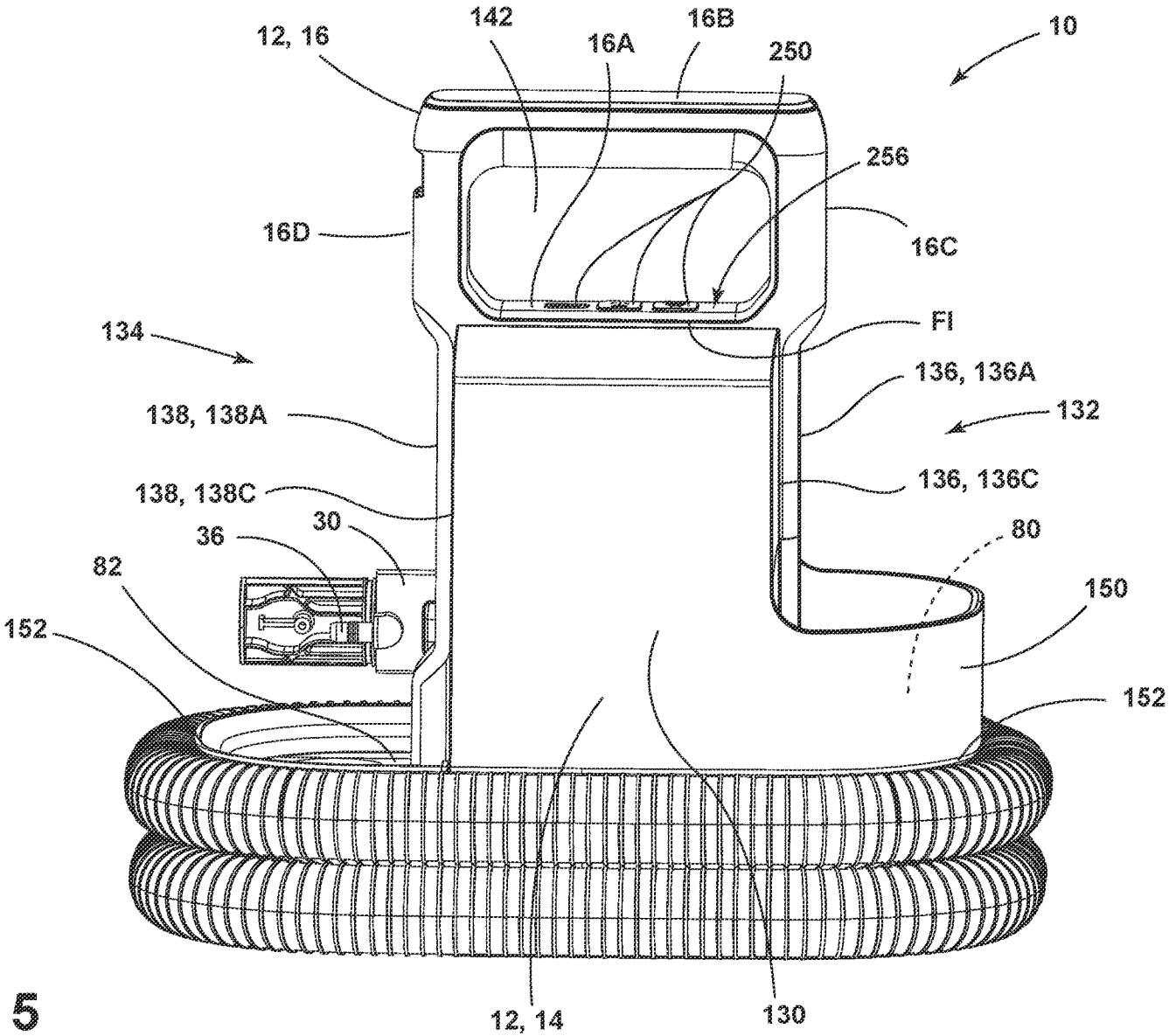
FIG. 5 is a front perspective view of an extraction cleaner with a supply tank assembly removed, a recovery tank assembly removed, and an accessory tool removed, according to the present disclosure.

As shown in FIGS. 2 and 5, the handle 16 includes a grip portion 16B, a first leg portion 16C extending from the first side wall 136 to the grip portion 16B, and a second leg portion 16D extending from the second side wall 138 to the grip portion 16B. The bottom portion 16A, the grip portion 16B, and the leg portions 16C, 16D together define an opening 142 through which fingers of a hand can extend when the hand is gripping the grip portion 16B to carry the extraction cleaner 10.

The first leg portion 16C is continuous with and extends upward from the protruding vertical column 136A of the first side wall 136 as best shown in FIGS. 5 and 6. The second leg portion 16D is continuous with and extends upward from the protruding vertical column 138A of the second side wall 138 as best shown in FIGS. 5 and 9.

FIG. 6 is a perspective view of the extraction cleaner 10 showing the supply tank seat 80 and the recovery tank seat 82 of the base 12. The supply tank seat 80 is adjacent to the first side wall 136. The housing 14 includes a first lower side wall 150 that is an arced or arcuate, vertically-extending wall that wraps around the supply tank seat 80 from the front wall 130 to the rear wall 122, partially surrounding the supply tank seat 80 so that it is enclosed from the first side 132 and is open from above. The first lower side wall 150 is shorter than the first side wall 136.

In contrast, the housing 14 forms a lower rim 152 that wraps around the recovery tank seat 82 from the front wall 130 to the rear wall 122. This same rim 152 extends at the bottom of the first lower side wall 150, as shown in FIGS. 5 and 6. The recovery tank seat 82 thus has greater lateral exposure (at the second side 134) than the lateral exposure of the supply tank seat 80 at the first side 132, as shown in FIG. 5. This helps to enable the removal of the recovery tank assembly 20 in the manner discussed herein.

Additionally, because the recovery tank seat 82 is disposed lower than the supply tank seat 80, the recovery tank 110 has a greater height than a supply tank 154 of the supply tank assembly 18. The supply tank 154 includes a lower wall portion 154A extending from a bottom wall 154B and an exterior wall 154C extending from the lower wall portion 154A. Given the greater height of the recovery tank 110, that the recovery tank 110 and the supply tank 154 have a same width and length, and that each extends to approximately the same height on the handle 16, the recovery tank 110 has a greater internal volume than the supply tank 154.

Figure 10:
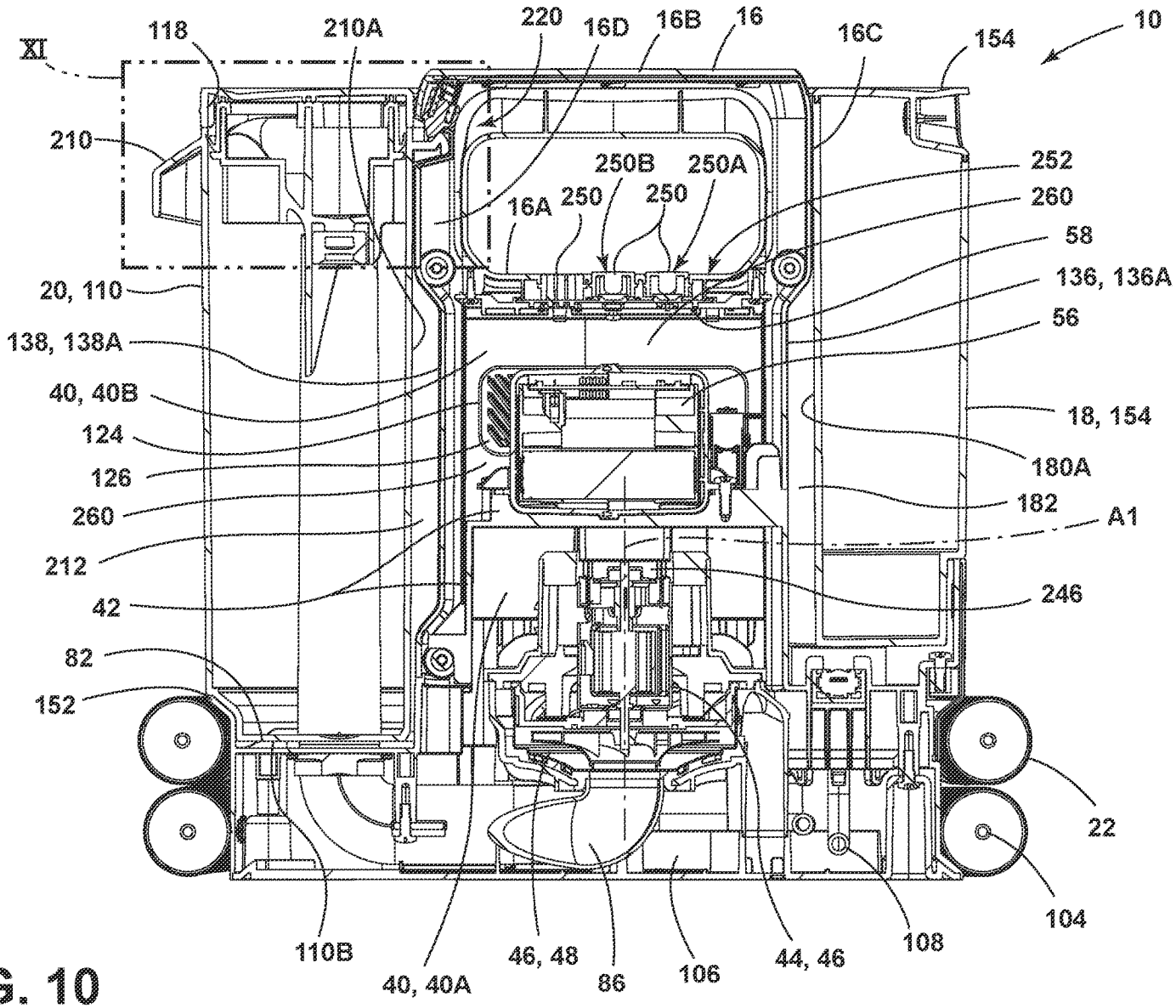
FIG. 10 is a cross-sectional view of the extraction cleaner of FIG. 1, taken at line X-X and with the accessory tool removed, according to the present disclosure.

Because the recovery tank 110 should have sufficient volume to contain the maximum fill volume of the supply tank 154 after pickup of the dispensed cleaning fluid and additional internal volume for separation of the air portion of the working air stream, providing the lower recovery tank seat 82 can achieve these goals while still maintaining a top portion 156, including a top 156A, of the supply tank 154 and the recovery tank lid 118 at approximately the same height. Each of the supply tank 154 and the recovery tank 110 with the lid 118 extend to a height that is slightly lower than the top of the grip portion 16B so as not to interfere with accessing the grip portion 16B. Additionally, by placing the supply tank seat 80 higher (e.g., elevated above the skirt 24 and the rim 152 by the first lower side wall 150), the internal cavity 40 can extend under the supply tank seat 80 to the first lower side wall 150, providing additional packaging space for the fluid line 108 and other components, as shown in FIG. 10.

Figure 7:
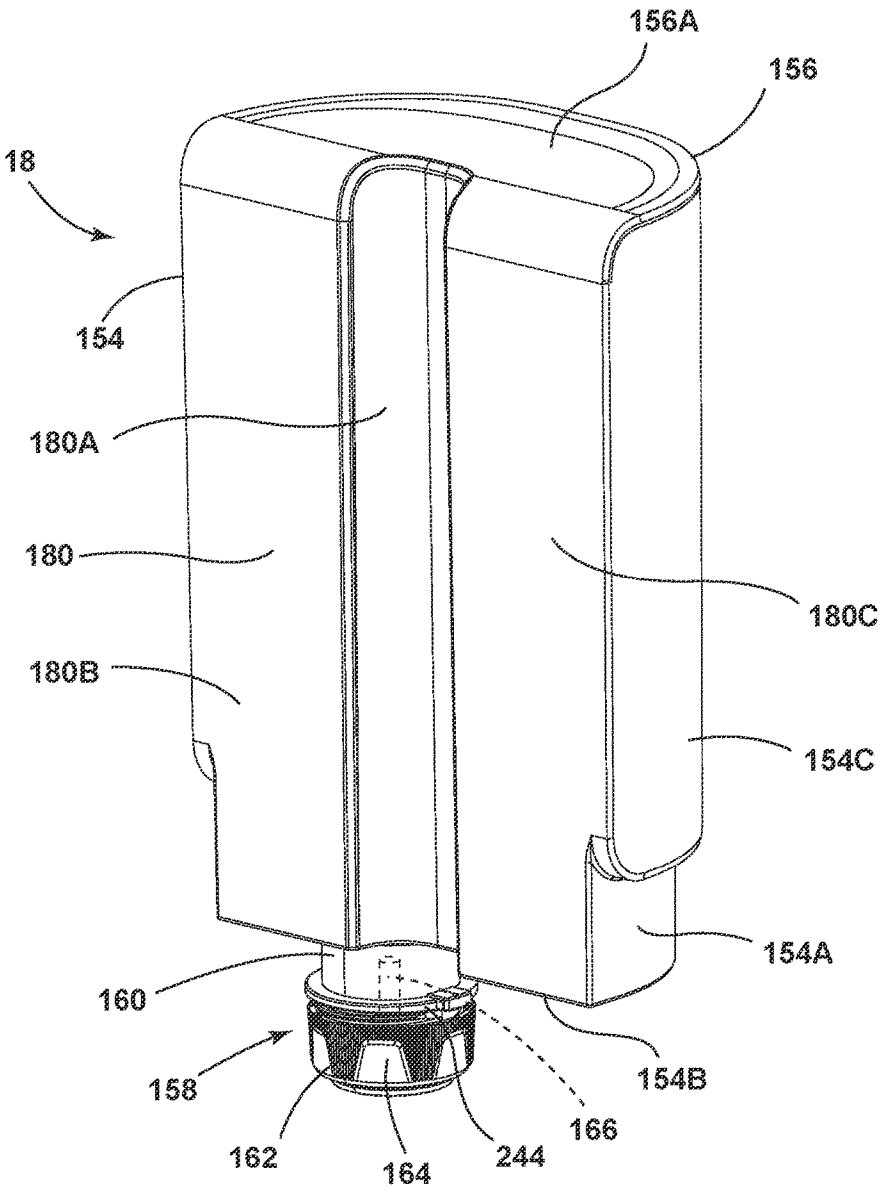
FIG. 7 is a side perspective view of a supply tank assembly for an extraction cleaner, showing an inner wall having a vertical channel, according to the present disclosure.

FIG. 7 shows the supply tank assembly 18 that includes the supply tank 154 with an integral supply tank top portion 156, and a cap assembly 158 threaded to a neck 160 of the supply tank 154. The cap assembly 158 includes an external threaded ring 162 and a cap 164 on which the ring 162 is rotatably mounted so that the ring 162 is rotatable relative to the cap 164. The cap assembly 158 is removable so that the supply tank 154 may be filled with cleaning fluid through the neck 160. A plunger valve 166 is disposed in the center column of the cap 164 and is shown in phantom in FIG. 7.

As shown in FIG. 6, the supply tank seat 80 has a receiver opening 168 and a seal 170 disposed around the receiver opening 168. The seal 170 is shown at the opening 168 for purposes of illustration but may be carried on the cap 164 to seal the cap 164 at the receiver opening 168. A screen 172 is disposed over the opening 168. The cap 164 is sized to be received within the receiver opening 168 and a receiving component 174 functionally mates with the cap 164 at the opening 168 to actuate the valve 166, opening the valve 166 and allowing flow from the supply tank 154 through the cap 164 and then through the fluid line 108 (shown in FIG. 10) that extends to the fluid pump 106. The supply tank assembly 18 thus fluidly couples with the fluid pump 106 at the supply tank seat 80.

A user sets the supply tank assembly 18 at the supply tank seat 80 to actuate the valve 166. The lower wall portion 154A of the supply tank 154 is supported against the first lower side wall 150 inward thereof and has an arcuate shape that mates to the arcuate shape of the first lower side wall 150. The exterior wall 154C of the supply tank 154 above the lower wall portion 154A also has an arcuate shape that matches the arcuate shape of the first lower side wall 150, extending flush with the first lower side wall 150 above the first lower side wall 150. The bottom wall 154B of the supply tank 154 is supported at the supply tank seat 80 shown in FIG. 6.

As shown in FIG. 7, the supply tank 154 of the supply tank assembly 18 has an inner wall 180 that forms a vertical inner channel 180A between a rear planar portion 180B and a front planar portion 180C of the inner wall 180. The vertical channel 180A extends from the bottom wall 154B of the supply tank assembly 18 (e.g., the bottom wall 154B of the supply tank 154) to a top of the supply tank assembly 18 (e.g., to the top 156A of the top portion 156), opening upward at the top 156A of the top portion 156.

The supply tank assembly 18 is configured to be received by the supply tank seat 80, with the inner wall 180 interfitting with the first side wall 136 of the housing 14 and with the first leg portion 16C of the handle 16, extending along the first leg portion 16C to the grip portion 16B, as best shown in FIG. 3. Specifically, the protruding vertical column 136A interfits with and is nested in the vertical channel 180A of the supply tank 154, and the first leg portion 16C also interfits with and is nested in the vertical channel 180A above the vertical column 136A. The vertical channel 180A extends to the grip portion 16B when the supply tank 154 is seated at the supply tank seat 80.

The first leg portion 16C is vertical and protrudes laterally further than the vertical column 136A (see FIG. 5). Because of this, the first leg portion 16C will fill the vertical channel 180A whereas a gap 182 will remain in a portion of the vertical channel 180A not filled by the vertical column 136A (see FIG. 10). Because the vertical channel 180A extends vertically from the bottom wall 154B to the top 156A of the top portion 156, the handle 16 does not extend laterally outward over the supply tank assembly 18. Stated differently, the supply tank assembly 18 is disposed adjacent to the handle 16 such that there is no part of the supply tank assembly 18 directly under the first leg portion 16C when the supply tank assembly 18 is seated at the supply tank seat 80. In this way, the supply tank assembly 18 is free of any portion of the handle 16 extending laterally over the top 156A of the supply tank 154.

The front planar portion 136C of the first side wall 136 interfaces with the front planar portion 180C of the supply tank 154, and the rear planar portion 136B of the first side wall 136 interfaces with the rear planar portion 180B of the supply tank 154. As best shown in FIGS. 1 and 6, the first leg portion 16C is narrower than the first side wall 136 of the housing 14. Additionally, the inner wall 180 of the supply tank 154 is wider than the first leg portion 16C. Accordingly, when the supply tank assembly 18 is seated at the supply tank seat 80, a portion of the inner wall 180 (e.g., the top regions of the front planar portion 180C and the rear planar portion 180B) is exposed over the housing 14 on opposing sides of the handle 16, including forward of the handle 16 (the top region of the front planar portion 180C, as shown in FIGS. 1 and 9) and rearward of the handle 16 (the top region of the rear planar portion 180B, as also shown in FIGS. 1 and 9).

Figure 8:
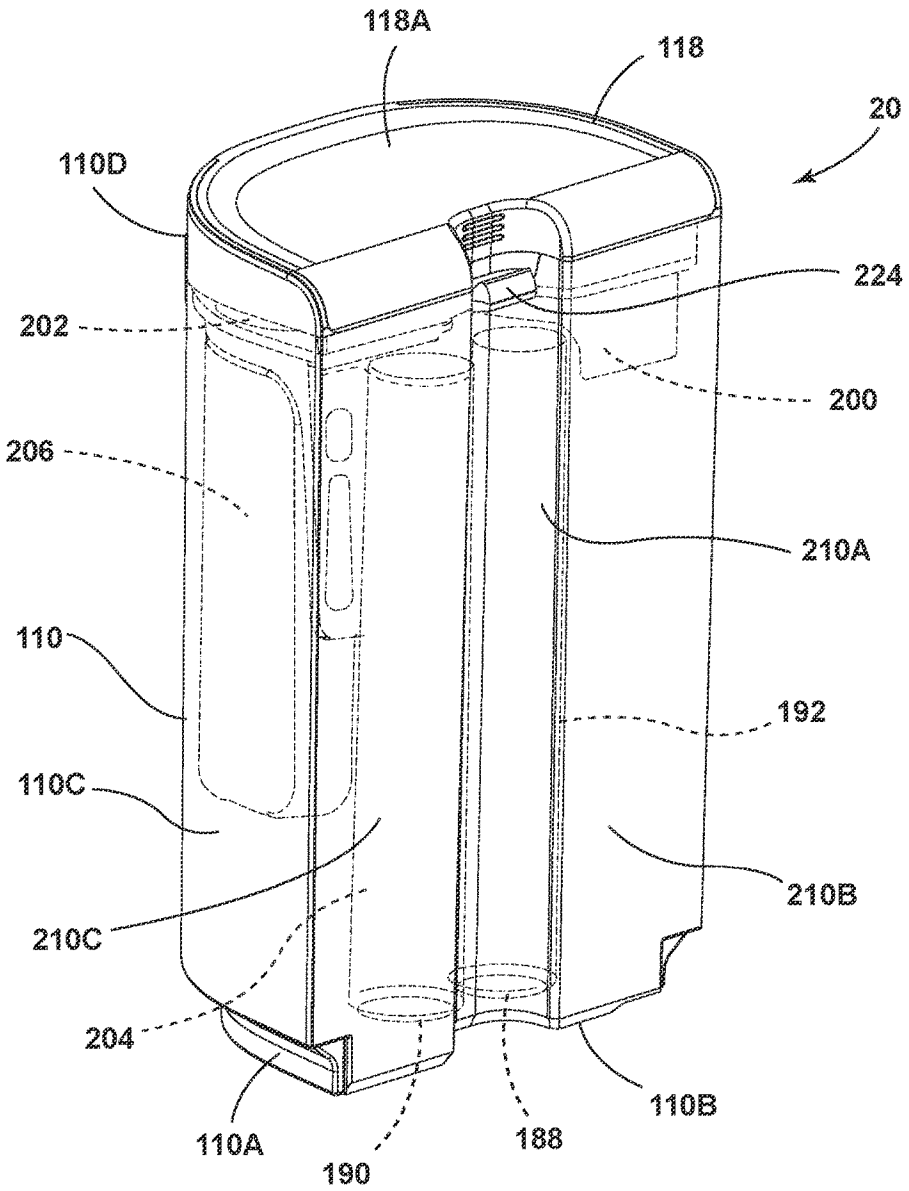
FIG. 8 is a side perspective view of a recovery tank assembly for an extraction cleaner, showing an inner wall having a vertical channel with a projection in the vertical channel, according to the present disclosure.

FIG. 8 shows the recovery tank assembly 20 that includes the recovery tank 110 and the recovery tank lid 118 removably couplable to the recovery tank 110 for emptying the recovery tank 110. Specifically, the recovery tank lid 118 is mounted to the top 110D of the recovery tank 110 opposite from the bottom wall 110B of the recovery tank 110.

Referring again to FIG. 6, as well as FIG. 8, the recovery tank seat 82 has a first receiver opening 184 and a second receiver opening 186. The recovery tank 110 has a first opening 188 that mates with the first receiver opening 184 and a second opening 190 that mates with the second receiver opening 186 when the recovery tank assembly 20 is received by the recovery tank seat 82. The recovery tank assembly 20 fluidly couples with the working airstream via the first receiver opening 184, which provides a mixture of dirty liquid and air from the suction hose 22 that travels upward in an inlet pipe 192 within the recovery tank 110 to a deflector cavity 200 within the lid 118, which causes the liquid to fall to the bottom of the recovery tank 110 by gravity, separating from the air.

The air can then exit from the recovery tank 110 through an opening 202 at the bottom of the lid 118 through which the air is then routed through the lid 118 internally in the recovery tank 110 to an outlet pipe 204 to the second opening 190 and through the conduits 86 to the motor and impeller assembly 46, 48 to be exhausted from the extraction cleaner 10. A float 206 moves upward to close the opening 202 in the lid 118 at a predetermined liquid level, preventing air flow through the opening 202, thereby indicating a full recovery tank 110 and thus prompting the user to empty the recovery tank 110.

The lower wall portion 110A of the recovery tank 110 is supported against the lower rim 152 and has an arcuate shape that mates to the arcuate shape of the lower rim 152 inward thereof. The exterior wall 110C of the recovery tank 110 above the lower wall portion 110A also has an arcuate shape that matches the arcuate shape of the lower rim 152, extending flush with the lower rim 152 above the lower rim 152. The exterior wall 110C is opposite from an inner wall 210. The bottom wall 110B of the recovery tank 110 rests against the recovery tank seat 82 as shown in FIG. 10.

As shown in FIG. 8, the recovery tank 110 has the inner wall 210 that forms a vertical inner channel 210A between a rear planar portion 210B and a front planar portion 210C of the inner wall 210 and which extends from the bottom wall 110B of the recovery tank assembly 20 (e.g., the bottom wall 110B of the recovery tank 110) to a top of the recovery tank assembly 20 (e.g., to the top 118A of the lid 118), opening upward at the top 118A of the lid 118. Stated differently, the vertical channel 210A extends along both the recovery tank 110 and the recovery tank lid 118 as a continuous recess in the recovery tank 110 and in the recovery tank lid 118.

The recovery tank assembly 20 is configured to be received by the recovery tank seat 82 with the inner wall 210 interfitting with the second side wall 138 of the housing 14 and with the second leg portion 16D of the handle 16, extending along the second leg portion 16D to the grip portion 16B, as best shown in FIGS. 3 and 10. Specifically, the protruding vertical column 138A interfits with and is nested in the vertical channel 210A of the recovery tank 110 and the second leg portion 16D also interfits with and is nested in the vertical channel 210A of the recovery tank 110 above the vertical column 138A.

The vertical column 138A extends to the grip portion 16B when the recovery tank 110 is seated at the recovery tank seat 82. The second leg portion 16D is vertical and protrudes laterally further than the vertical column 138A and fills the vertical channel 210A whereas a gap 212 will remain in a portion of the vertical channel 210A not filled by the vertical column 138A. Because the vertical channel 210A extends vertically from the bottom wall 110B to the top 118A of the lid 118, the handle 16 does not extend laterally outward over the recovery tank assembly 20. Stated differently, the recovery tank assembly 20 is adjacent to the handle 16, such that there is no part of the recovery tank assembly 20 directly under the second leg portion 16D when the recovery tank assembly 20 is seated at the recovery tank seat 82. In this way, the recovery tank assembly 20 is free of any portion of the handle 16 extending laterally over the top 118A of the lid 118.

The front planar portion 138C of the second side wall 138 interfaces with the front planar portion 210C of the recovery tank 110, and the rear planar portion 138B of the second side wall 138 interfaces with the rear planar portion 210B of the recovery tank 110. As best shown in FIG. 9, the second leg portion 16D is narrower than the second side wall 138 of the housing 14. Additionally, the inner wall 210 of the recovery tank 110 is wider than the second leg portion 16D. Due to this, when the recovery tank assembly 20 is seated at the recovery tank seat 82, a portion of an inner wall 210 (e.g., the top regions of the front planar portion 210C and the rear planar portion 210B) is exposed over the housing 14 on opposing sides of the handle 16, including forward of the handle 16 (the top region of the front planar portion 210C, as shown in FIG. 12) and rearward of the handle 16 (the top region of the rear planar portion 210B, as also shown in FIG. 12).

Figure 11:
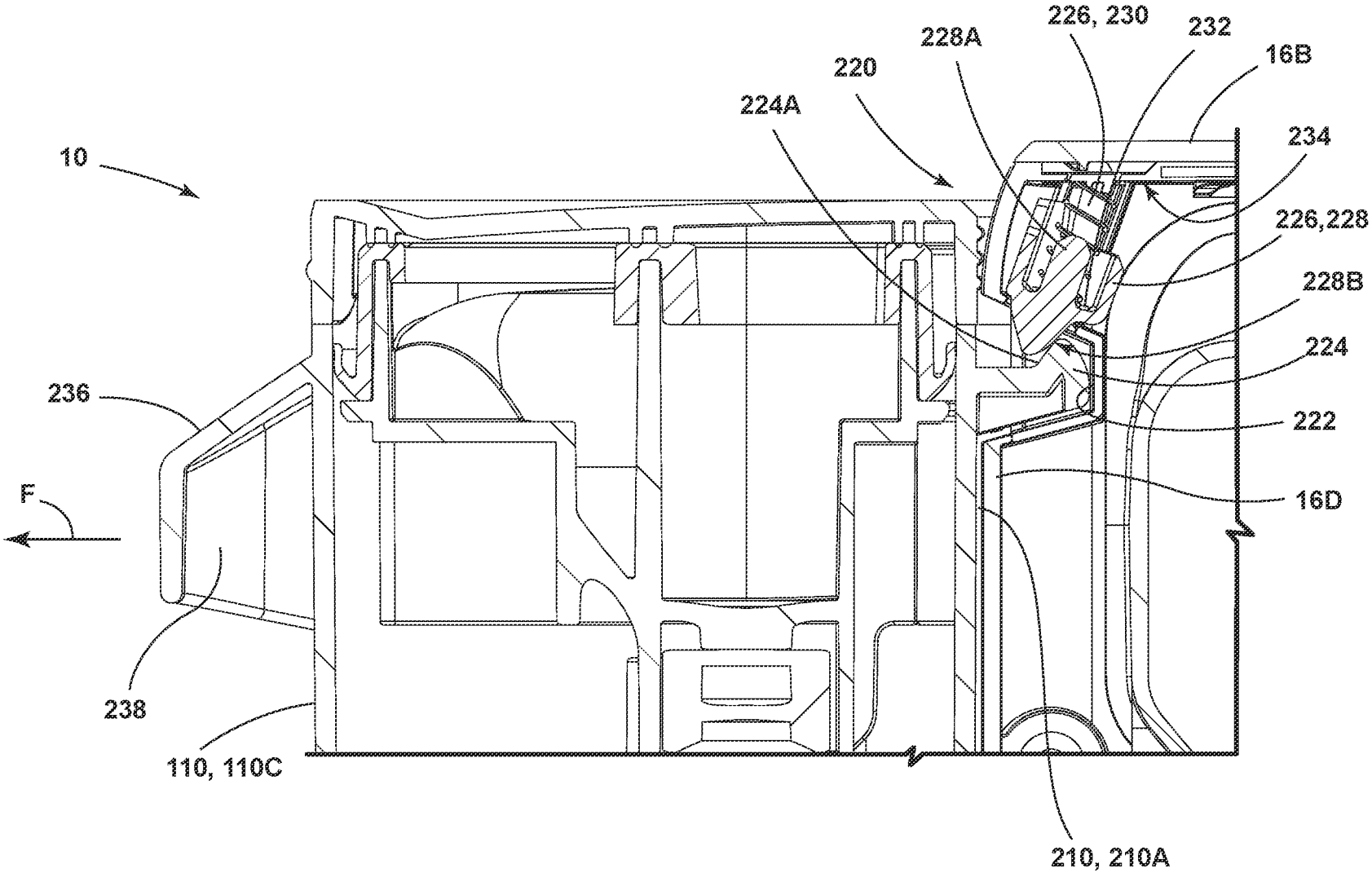
FIG. 11 is an enlarged partial cross-sectional view of a portion of the extraction cleaner of FIG. 10, taken at area XI and showing a spring-biased latch engaging a projection of a recovery tank assembly, according to the present disclosure.

With reference to FIGS. 10 and 11, the taller recovery tank 110 having more lateral exposure than the supply tank 154 as discussed herein (due to the rim 152 being shorter than the first lower side wall 150) is releasably latched to the base 12 in a manner that ensures stability when the extraction cleaner 10 is in use and promotes ease of removal for emptying of the recovery tank 110. Specifically, a latching assembly 220, shown best in FIGS. 10 and 11, is operable to latch the recovery tank assembly 20 to the base 12 when the inner wall 180 of the recovery tank 110 is interfit with the second side wall 138 of the housing 14. Specifically, the recovery tank assembly 20 is latched to the handle 16 of the base 12, and more specifically to the second leg portion 16D of the handle 16.

The inner wall 180 of the recovery tank 110 includes a feature that is engaged by the latching assembly 220 to latch the recovery tank assembly 20 to the base 12 when the inner wall 180 of the recovery tank 110 is interfit with the second side wall 138. The feature at the inner wall 180 of the recovery tank assembly 20 is a projection 224 having a ramped lip 224A, best shown in FIGS. 8 and 11, which extends from the recovery tank 110 in the vertical channel 210A near a top of the recovery tank 110 just below the lid 118.

The handle 16 of the base 12 includes a notch 222 that is aligned with the projection 224 when the inner wall 180 of the recovery tank 110 is interfit with the second side wall 138. More specifically, the second leg portion 16D of the handle 16 includes the notch 222, as is also apparent in FIG. 9. The latching assembly 220 includes a spring-biased latch 226 at the notch 222, as shown in FIG. 11. The spring-biased latch 226 includes a latch body 228 having a center post 228A and an engagement surface 228B. A spring 230 is disposed around the center post 228A of the latch body 228 and captured between an internal surface 232 of the latch body 228 and an inner surface 234 of the grip portion 16B of the handle 16. The spring 230 may be, but is not limited to, a compression spring, and urges the latch body 228 outward to the latched position shown in FIG. 11 in which it engages the projection 224.

The projection 224 has the ramped lip 224A and the engagement surface 228B of the latch body 228 is rounded, allowing the engagement surface 228B to slide over the ramped lip 224A as the projection 224 moves laterally inward into the notch 222 as the recovery tank 110 is moved laterally inward to interfit with the second side wall 138. As the projection 224 moved inward into the notch 222, the latch body 228 is moved against the biasing force of the spring 230 by the ramped lip 224A and then is moved by the biasing force for the engagement surface 228B to engage the ramped lip 224A, latching the recovery tank 110 with the base 12. The spring 230 is selected with a spring rate sufficient to maintain the spring-biased latch 226 in the latched state during use of the extraction cleaner 10.

To unlatch the recovery tank assembly 20 from the base 12, the user pulls a protrusion 236 at the exterior wall 110C of the recovery tank 110 opposite from the inner wall 210 and the latching assembly 220. The protrusion 236 may also be referred to as a pull or pull feature, as the protrusion 236 has a downward-opening cavity 238 in which the user's fingers may reside while pulling laterally outward on the protrusion 236, similar to operation of a drawer pull. The protrusion 236 and the spring-biased latch 226 are configured such that pulling the protrusion 236 laterally outward away from the handle 16 with a force in the direction of arrow F in FIG. 11 unlatches the latching assembly 220 by disengaging the spring-biased latch 226 from the projection 224.

The projection 224 will force the latch body 228 upward, compressing the spring 230 as the projection 224 moves laterally outward with the recovery tank 110. The rim 152 is very low on the recovery tank 110 and has an outwardly-flared shape that is evident in FIG. 10. This helps to enable the recovery tank assembly 20 to pivot slightly outward about the rim 152 as the protrusion 236 is pulled laterally outward and the latching assembly 220 is unlatched (e.g., disengaged from the projection 224). Once the latching assembly 220 is unlatched, the user can then lift upward on the recovery tank assembly 20 to remove it from the recovery tank seat 82.

The supply tank assembly 18 is latched to the base 12 via a spring-biased latch 240 that is housed under the supply tank seat 80 as shown in FIG. 6. The latch 240 is biased toward the receiver opening 168 by a spring 242 also housed under the supply tank seat 80 (indicated with hidden or dashed lines). The latch 240 may engage the neck 160 of the supply tank 154 under a flange 244 (see FIG. 7) when the supply tank assembly 18 is seated at the supply tank seat 80. To remove the supply tank assembly 18, a user pulls straight upward on the supply tank assembly 18, with the neck 160 pushing laterally outward on the latch 240 sufficiently to overcome the spring 242 and cause the latch 240 to retract from the neck 160. To refill the supply tank 154, the supply tank 154 is inverted so that the cap 164 is facing upward with the top portion 156 facing downward, the cap 164 is removed, and cleaning fluid is poured into the supply tank 154 through the neck 160.

Referring to FIGS. 10 and 12, a cooling fan 246 is disposed within the cavity 40 of the housing 14 between the battery pack 56 and the motor and impeller assembly 46, 48 and is rotatably driven by the motor and impeller assembly 46, 48. The battery pack 56 is disposed within the cavity 40 of the housing 14 above the motor and impeller assembly 46, 48. The battery pack 56 may include a plurality of interconnected battery cells 56A and the battery cover 56B. The battery cells 56A are rechargeable via an external power source, such as a wall plug, that can be connected via a power cord to a charging jack 248 shown in FIG. 2 that is in turn operatively connected to the battery cells 56A via wiring extending from the charging jack 248 to the battery pack 56 within the internal cavity 40. The extraction cleaner 10 is cordless in the implementation shown, in that it is not equipped with a cord connectable to an external power source for powering the extraction cleaner 10 during use. Instead, the battery pack 56 powers the extraction cleaner 10 during use, which increases maneuverability of the extraction cleaner 10 during use.

The PCBA 58 is disposed within the internal cavity 40 in the housing 14 above the battery pack 56 and may be mounted to the inner side of the top wall 140 of the housing 14 and/or the inner side of the bottom portion 16A of the handle 16. A user interface 250 is disposed at an exterior of the bottom portion 16A of the handle 16 and is operatively connected to the PCBA 58. The user interface 250 may include a plurality of depressible buttons, switches, touch features, or other components that enable a user to control the operation of the extraction cleaner 10, such as by powering the extraction cleaner 10 on or off, selecting operating modes, etc.

As best shown in FIGS. 2 and 10, at least some of the user interface 250 is elevated above the exterior of the bottom portion 16A. For example, top surfaces 250A, 250B of at least some buttons of the user interface 250 are above an exterior surface 252 of the bottom portion 16A, extending into the opening 142.

Additionally, the handle 16 and the housing 14 are configured to aid in the prevention of water ingress at the user interface 250. For example, the handle 16 has an inner ring portion 254 that defines the bottom portion 16A, a bottom side of the grip portion 16B, an inner side of the first leg portion 16C, and an inner side of the second leg portion 16D, creating the opening 142. As is apparent in FIGS. 1 and 9, the inner ring portion 254 has a front perimeter that defines a front interface FI at which the inner ring portion 254 interfits with the top side of the grip portion 16B, with the outer sides of the leg portions 16C, 16D, and with the front top wall portion 140B of the housing 14. Similarly, as is apparent in FIG. 2, the inner ring portion 254 has a rear perimeter that defines a rear interface RI at which the inner ring portion 254 interfits with the top side of the grip portion 16B, with the outer sides of the leg portions 16C, 16D, and with the rear top wall portion 140A of the housing 14.

The inner ring portion 254 curves outward and downward from the exterior surface 252 of the bottom portion 16A to the rear interface RI at inclined surface 256 (best shown in FIGS. 3 and 12) and curves outward and downward from the exterior surface 252 of the bottom portion 16A to the front interface FI at inclined surface 258 shown in FIG. 1 (also shown in FIG. 9). In this way, the front and rear interfaces FI, RI are both outward of and below the user interface 250 to aid in prevention of water ingress into the internal cavity 40 of the housing 14 at the user interface 250.

The housing 14 is constructed such that the internal cavity 40 includes a cooling space 260 that extends around the battery pack 56 between the battery pack 56 and the housing 14. More specifically, the cooling space 260 extends above the battery pack 56 and below the PCBA 58 (e.g., between the top wall 140 and the battery pack 56, between the front wall 130 and the battery pack 56, and between the rear wall 122 and the battery pack 56, all as shown in FIG. 12). Additionally, the cooling space 260 extends between the first side wall 136 and the battery pack 56, and between the second side wall 138 and the battery pack 56, as shown in FIG. 10. The cooling fan 246 is disposed directly below the battery pack 56 between the internal wall 42 and the battery pack 56 without other components therebetween.

When the cooling fan 246 is powered on (e.g., is rotating about a vertical axis A1 shown in FIGS. 10 and 12), ambient air from outside of the housing 14 is drawn into the cooling space 260 through the air inlet 124 by the cooling fan 246. At least a portion of the rear wall 122 extends generally parallel with the rotational axis A1 of the cooling fan 246 such that air drawn through the air inlet 124 is at an angle to the rotational axis A1 and a flow path P1 of ambient air pulled into the cooling space 260 through the air inlet 124 by the cooling fan 246 is nonlinear. At least a portion of the front wall 130 also extends generally parallel with the rotational axis A1. It should be appreciated that the air inlet 124 could instead be disposed in the front wall 130.

An example of such the flow path P1 is shown in FIG. 12. The flow path P1 includes representative branches P1A, P1B. At least some of the flow of ambient air that enters through the air inlet 124 is drawn downward between the rear wall 122 of the housing 14 and the battery pack 56 as represented by branch P1A of the flow path P1. At least some of the flow of ambient air that enters through the air inlet 124 flows over the top of the battery pack 56 and downward between the front wall 130 and the battery pack 56 as represented by branch P1B of the flow path P1. Similarly, some of the flow of ambient air that enters through the air inlet 124 may go over the top of the battery pack 56 and downward between the first side wall 136 and the battery pack 56, while some may go over the top of the battery pack 56 and downward between the second side wall 138 and the battery pack 56. Stated differently, due to the arrangement of the air inlet 124, the cooling fan 246, and the cooling space 260, the cooling air generally flows around the entire battery pack 56.

The nonlinear flow path P1 helps minimize or prevent stagnant areas within the internal cavity 40. As air is drawn in, the warmer air within the internal cavity 40 is pushed out by the cooling fan 246. The ambient air may flow over and around all sides of the battery pack 56 in the cooling space 260. Superior or improved cooling of the battery pack 56 provided by the arrangement of the cooling space 260, the air inlet 124, and the cooling fan 246 may extend the charge and/or the useful life of the electrical components, including the motor 46, the PCBA 58, and the battery pack 56.

As previously discussed, the fluid delivery line 104 extends through the suction hose 22 and is fluidly coupled to the spray nozzle 36, such as by exiting the suction hose 22 via a route through the wand 30 or coupling to a structure creating a fluid path through the wand 30 to the spray nozzle 36. The opposite end 104A of the fluid delivery line 104 closer to the base 12 includes a fluid delivery line fitting 264 that is secured to a first coupling 266 for fluid communication with the fluid pump 106. A valve 268 is disposed within the housing 14 at the first coupling 266 and is configured to open when the fitting 264 of the fluid delivery line 104 couples to the first coupling 266. The open valve 268 permits fluid flow from the fluid pump 106 (FIG. 10), through a feed line 270 within the internal cavity 40 and connected to the fluid pump 106, and to an inlet 272 of the valve 268 to provide pressurized fluid flow to the fluid delivery line 104.

The suction hose 22 has the inlet 28, described with respect to FIG. 2, through which the working air stream is drawn through the suction hose 22 by the motor and impeller assembly 46, 48. The suction hose 22 includes both the flexible hose portion 22A (shown in FIGS. 1 and 2, for example) and the hose fitting 22B (shown in FIGS. 14 and 15) to which a proximal end of the flexible hose portion 22A is coupled. The hose fitting 22B defines an outlet 274 of the suction hose 22 and is configured to couple to a second coupling 280 disposed adjacent to the first coupling 266 on the base 12. The second coupling 280 is in fluid communication with the suction source 44.

Figure 13:
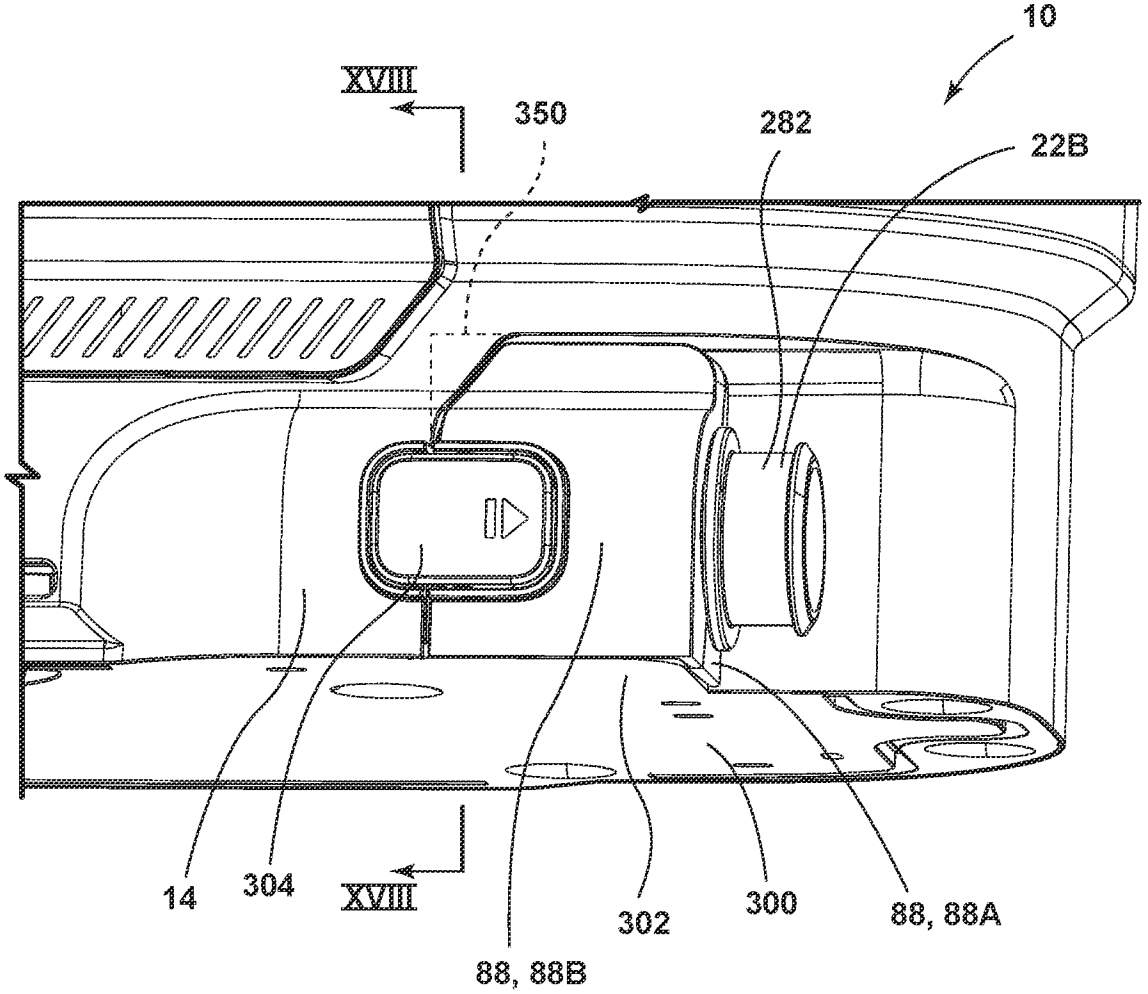
FIG. 13 is a partial side perspective view of an extraction cleaner with a flexible hose portion of a suction hose removed, and showing a mount supported on a hose end fitting of the suction hose and latched to a base of the extraction cleaner, according to the present disclosure.
Figure 14:
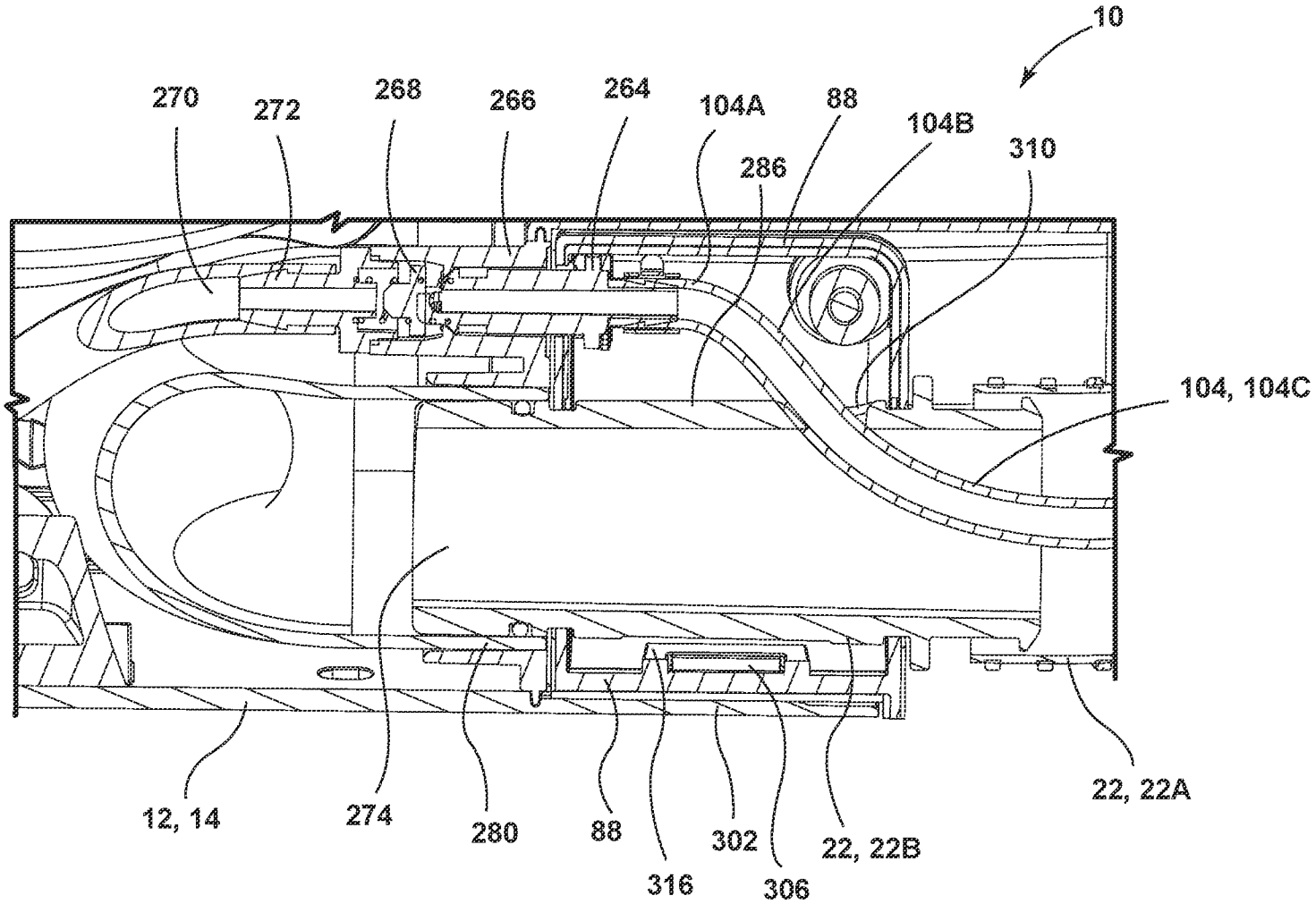
FIG. 14 is a partial cross-sectional view of the extraction cleaner of FIG. 2, taken at line XIV-XIV and showing a flexible hose portion of a suction hose coupled to a hose end fitting that is coupled to a coupling on a base of the extraction cleaner, according to the present disclosure.

FIG. 13 shows the mount 88 that is supported on and surrounds at least a portion of an outer wall 282 of the hose fitting 22B of the suction hose 22 adjacent to the outlet 274 of the suction hose 22, as shown in FIG. 14. The mount 88 includes the outer portion 88B, which has a receiving opening 284, and the inner portion 88A that receives a fastener 286 insertable in the opening 284, such that the mount portions 88A, 88B together surround an outer circumference of the hose fitting 22B and an outer circumference of the delivery line fitting 264. The outer portion 88B and the inner portion 88A are also referred to as the outer mount portion 88B and the inner mount portion 88A, respectively.

Figure 15:
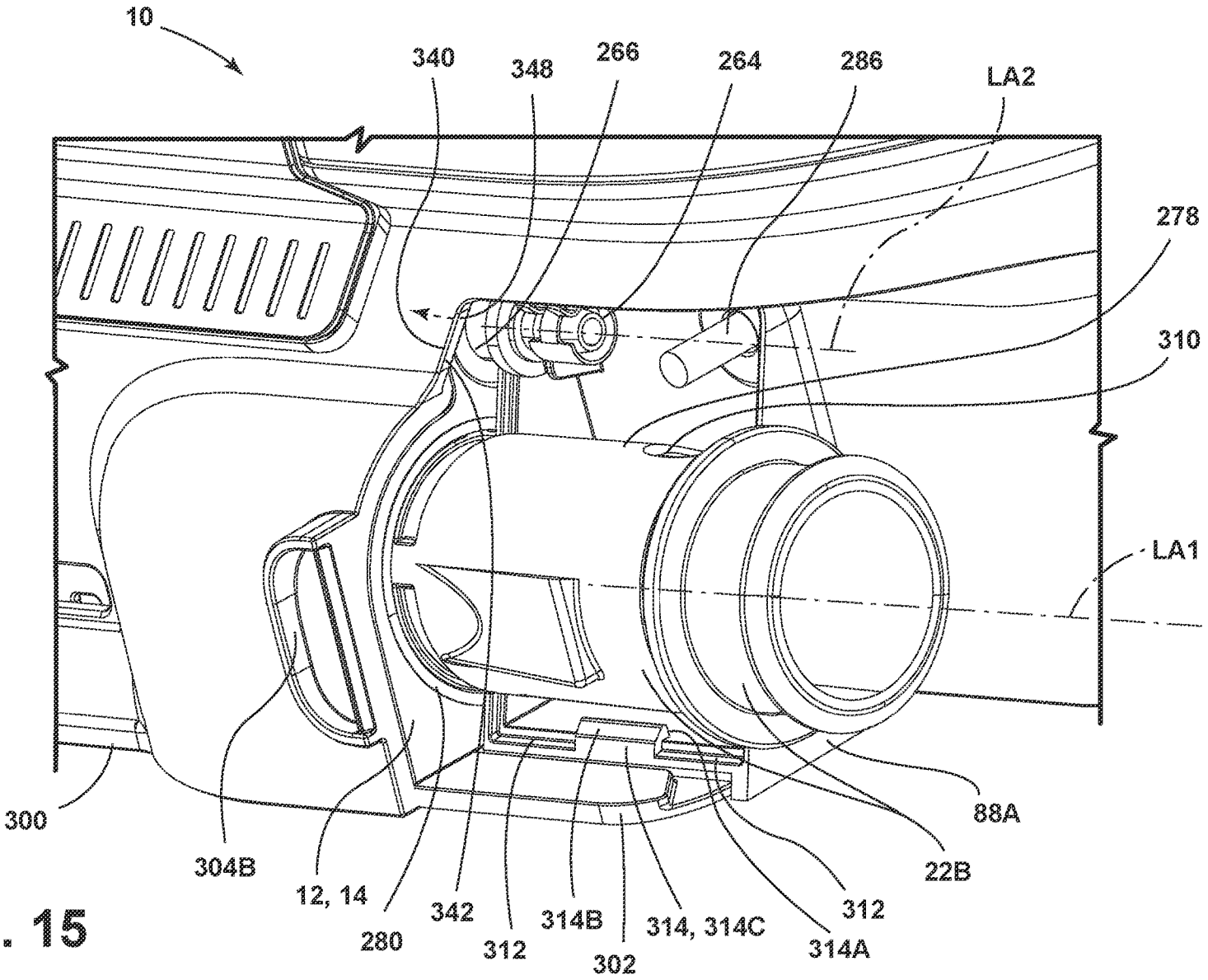
FIG. 15 is a partial side perspective view of an extraction cleaner with a flexible hose portion, a fluid delivery line, and a mount removed, according to the present disclosure.
Figure 17:
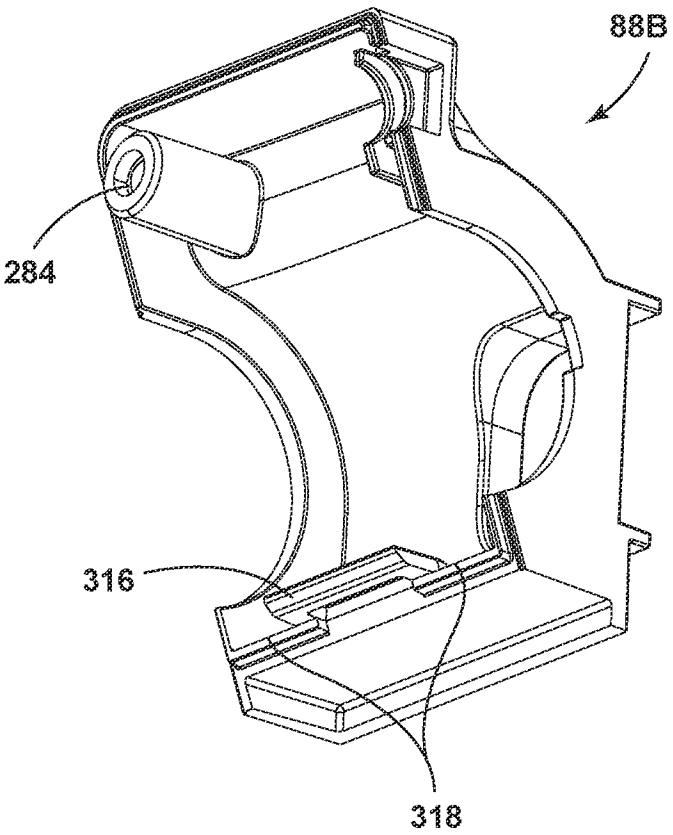
FIG. 17 is a side perspective view of an inner side of the portion of the mount shown in FIG. 16; according to the present disclosure.
Figure 16:
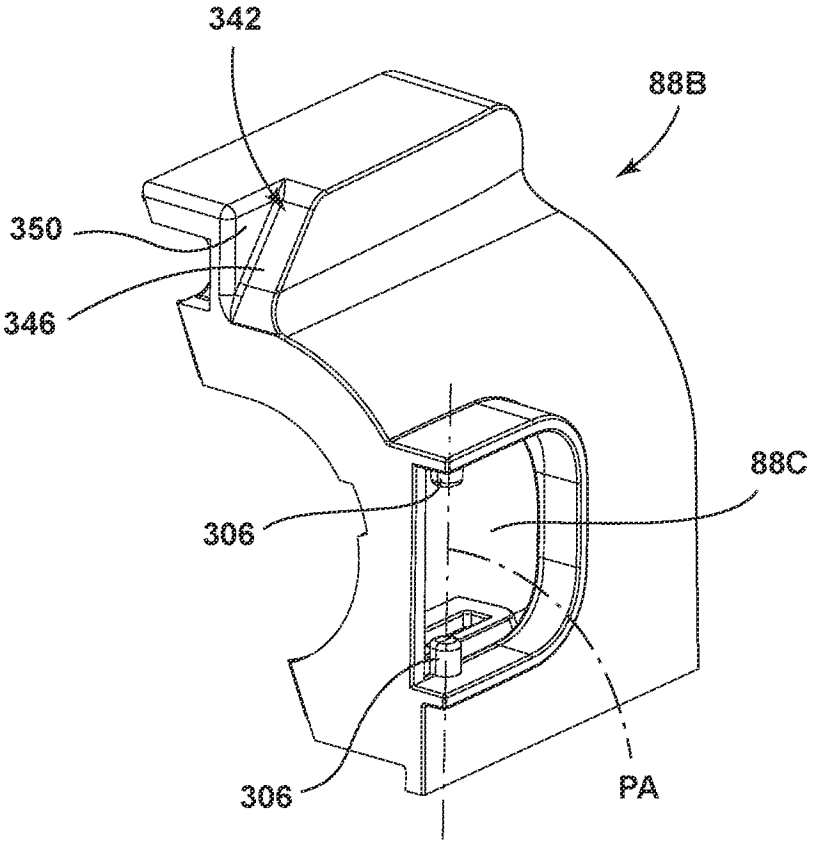
FIG. 16 is a side perspective view of an outer side of a portion of a mount of an extraction cleaner, according to the present disclosure.
Figure 18:
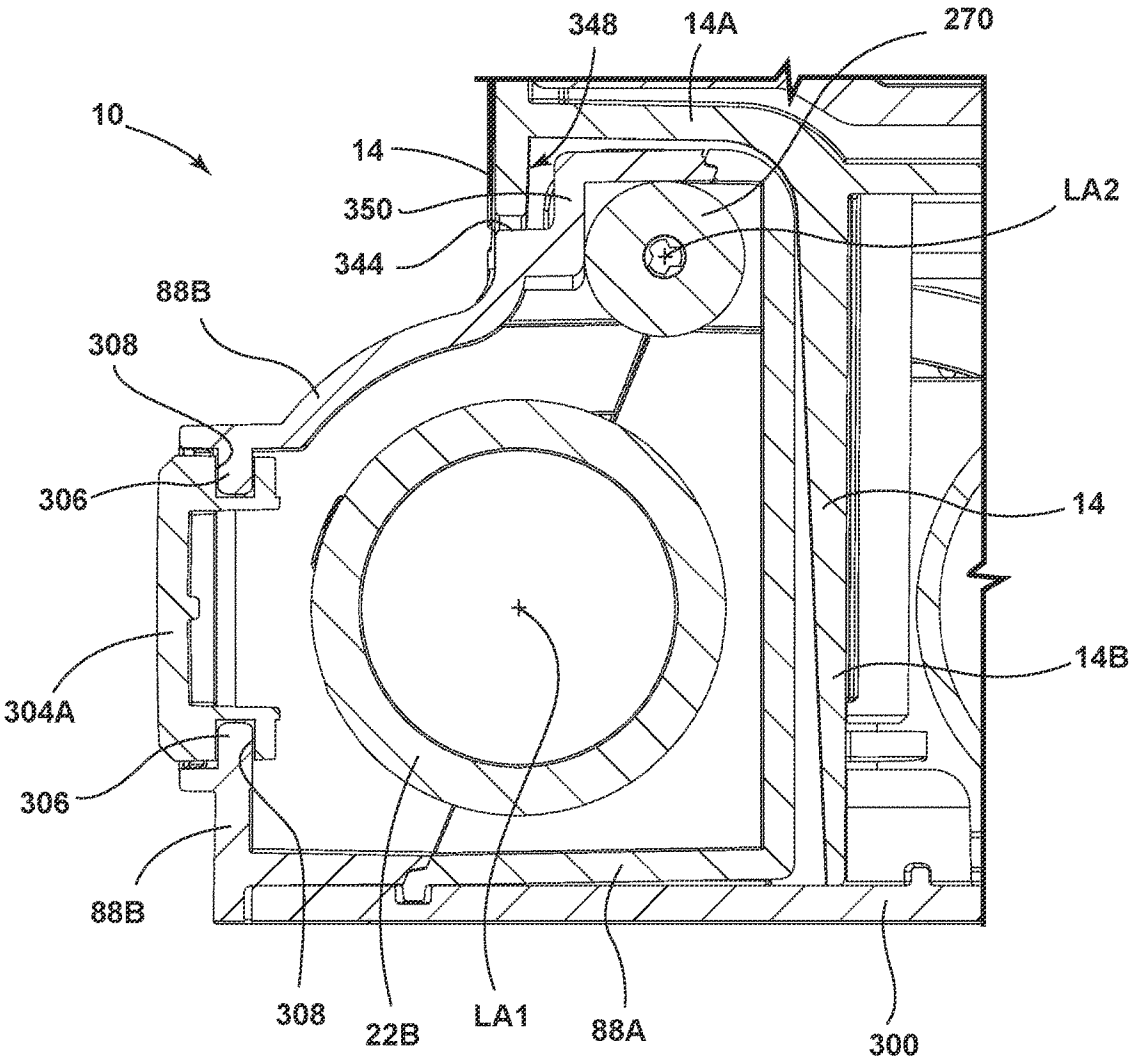
FIG. 18 is a partial cross-sectional view of the extraction cleaner of FIG. 13, taken at line XVIII-XVIII according to the present disclosure.

A bottom wall 300 of the housing 14 of the base 12 includes a platform 302 that extends outward under the fittings 22B, 264 and the mount 88, as best indicated in FIGS. 13 and 15. The inner mount portion 88A supports the locating post or fastener 286 that extends into the opening 284 (see FIG. 15) in the outer mount portion 88B to couple the outer mount portion 88B to the inner mount portion 88A. The mount 88 (with the two mount portions 88A, 88B secured to one another and surrounding the fittings 22B, 264, and with the fluid delivery line 104 and the flexible hose portion 22A secured to the respective fittings 264, 22B) fits onto the platform 302 and against a vertically extending side of the housing 14 of the base 12 near or proximate to the bottom wall 300. The portion 14A of the housing 14 extends laterally outward so that the mount 88 is partially nested between the portion 14A, the platform 302, and the vertically extending side portion 14B of the housing 14 as shown in FIG. 18.

A pivotable latching assembly 304 shown in FIG. 13 is secured to the outer mount portion 88B and is operable to latch the mount 88 to the base 12. The latching assembly 304 includes a pivotable latch 304A that is pivotably connected to the outer mount portion 88B at a pivot axis PA shown in FIG. 16. Posts 306 extend from the outer mount portion 88B at the opening 88C in the outer mount portion 88B and are received in blind holes 308 of the pivotable latch 304A as shown in FIG. 18. An inner side of the latch 304A latches to a latch receiver 304B (see FIG. 15) at the exterior of the base 12.

The mount 88 supports the fitting 264 of the fluid delivery line 104 and the hose fitting 22B of the suction hose 22 and properly spaces the components apart from one another so that they may be in alignment for connection with the respective couplings 266, 280. The hose fitting 22B has an opening 310 in the outer wall 282, as indicated in FIGS. 14 and 15. The fluid delivery line 104 is routed from the first coupling 266 and the fitting 264 through the mount 88 and through the opening 310 in the outer wall 282 of the hose fitting 22B of the suction hose 22 such that the fluid delivery line 104 has a first portion 104B extending through the mount 88 to the opening 310 and a second portion 104C internal to the suction hose 22 and extending between the opening 310 and the inlet 28 of the flexible hose portion 22A of the suction hose 22.

With the first portion 104B exiting the hose fitting 22B at the opening 310, the fluid delivery line 104 is thus spaced apart from the outlet 274 of the suction hose 22 (e.g., the outlet 274 of the hose fitting 22B). Keeping the fluid delivery line 104 away from the outlet 274 provides a greater area of the outlet 274 that is unblocked (e.g., increases the flow area through the suction hose 22 at the outlet 274 of the hose fitting 22B) and increases the ability to effectively pull the working airstream through the suction hose 22 and into the recovery tank assembly 20 via the suction source 44.

Because both the suction hose 22 and the fluid delivery line 104 may be moved with the cleaning tool 26 in various directions relative to the couplings 266, 280 during use of the cleaning tool 26 on the surface S of FIG. 2, the mount 88 is configured to secure to the base 12 with features that reduce twisting and outward movement (e.g., rocking) of the mount 88 relative to the base 12 in addition to the latching assembly 304. For example, FIG. 15 shows the extraction cleaner 10 with the first coupling 266 and the second coupling 280 disposed adjacent to one another on the base 12, with each of the outer mount portion 88B, the fluid delivery line 104, and the flexible hose portion 22A removed for clarity. The inner mount portion 88A has a recessed track 312 that includes a lip 314 with an inner wall 314A, a ramped surface 314B, and an outer wall 314C. The outer mount portion 88B is shown in isolation in FIGS. 16 and 17 and includes a protruding rib 318 and a catch 316 disposed over the protruding rib 318 and extending inward when the outer mount portion 88B is secured to the inner mount portion 88A and latched to the base 12.

The outer mount portion 88B is coupled to and interfits with the inner mount portion 88A to together at least partially surround (and, as shown, completely radially surround) the fittings 22B, 264. When the outer mount portion 88B is coupled to the inner mount portion 88A with the fastener 286, the protruding rib 318 rests in the recessed track 312. Stated differently, the protruding rib 318 is shaped and sized to interfit with the recessed track 312. The lip 314 interrupts the recessed track 312. The catch 316 is positioned on the outer mount portion 88B to engage the lip 314 when the protruding rib 318 rests in the recessed track 312.

The catch 316 slides over the ramped surface 314B of the lip 314 and is caught behind an inner wall 314A of the lip 314 to engage with the lip 314. The ramped surface 314B ramps upward and inward in a direction from an outer wall 314C of the lip 314 to the inner wall 314A. The interfitting and interfacing of the protruding rib 318 with the recessed track 312 and the catch 316 with the lip 314 extends in the direction of a longitudinal center axis LA1 of the hose fitting 22B and a longitudinal center axis LA2 of the fluid delivery line fitting 264 and thus helps to limit outward rocking of the mount 88 (and the hose fitting 22B, the delivery line fitting 264, the fluid delivery line 104, and the flexible hose portion 22A at the mount 88) relative to the base 12.

In addition to the fastener 286, the interfitting rib 318 and track 312, and the interfitting lip 314 and catch 316, the base 12 has a recess 340. An exterior surface 344 of the outer mount portion 88B of the mount 88 is shaped to fit into the recess 340 to limit movement of the mount 88 relative to the base 12. More specifically, as shown in FIG. 15, the base 12 has a wall 342 at the recess 340 that is angled relative to a longitudinal center axis LA1 of the second coupling 280 (which is the same as the longitudinal center axis LA1 of the hose fitting 22B). The exterior surface 344 of the outer mount portion 88B defines a ramp 346 (see FIG. 16) that interfaces with the wall 342 of the base 12 to help prevent upward rocking of the mount 88 (and the hose fitting 22B, the delivery line fitting 264, the fluid delivery line 104, and the flexible hose portion 22A at the mount 88) relative to the base 12.

Moreover, the base 12 includes an inner surface 348 and the outer mount portion 88B defines a wall 350 that fits inward of the inner surface 348 and just inward (e.g., forward) of the recess 340 and outward of the fittings 22B, 264 (see FIGS. 15 and 18). The inner surface 348 of the housing 14 inward (e.g., forward) of the recess 340 is indicated with a partially hidden arrow in FIG. 15. The wall 350 is represented with hidden lines in FIG. 13 in position inward of the housing 14. FIG. 18 shows the wall 350 disposed inward of and adjacent to the inner surface 348 of the housing 14 outward of the fittings 22B, 264.

The inner surface 348 of the housing 14 will interface with the wall 350 to limit outward rocking of the mount 88 (and the hose fitting 22B, the delivery line fitting 264, the fluid delivery line 104, and the flexible hose portion 22A at the mount 88) relative to the base 12. In fact, with the engaged catch 316 and lip 314 below the fittings 22B, 264 and the interfacing wall 350 and inner surface 348 of the housing 14 above the fittings 22B, 264 and outward of the fittings 22B, 264, twisting of the mount 88 (and the hose fitting 22B, the delivery line fitting 264, the fluid delivery line 104, and the flexible hose portion 22A at the mount 88) relative to the base 12 due to movement of the flexible hose portion 22A during use of the extraction cleaner 10 is limited or prevented by multiple features spaced apart from one another around the fittings 22B, 264. Stated differently, the interfitting features that limit or prevent twisting include the fastener 286 that interfits with the fastener opening 284, the lip 314 that interfits with the catch 316, and the wall 350 that interfits with the inner surface 348 of the housing 14. Each of these pairs of features is spaced angularly apart from one another around the longitudinal center axes LA1, LA2 of the fittings 22B, 264 to brace the mount 88 (and the hose fitting 22B, the delivery line fitting 264, the fluid delivery line 104, and the flexible hose portion 22A at the mount 88) relative to the base 12.

Use of the present device provides a variety of advantages. The extraction cleaner 10 thus enables a compact design that fully utilizes the handle 16 to help support the supply tank assembly 18 and the recovery tank assembly 20 and integrates the latching assembly 220 into the base 12, such as at the handle 16. The structure of the carrying handle 16 of the extraction cleaner 10 may be utilized in order to permit the recovery and supply tanks 110, 154 to be taller, and therefore provide tank volume without expanding a width of the base 12. The mount 88 helps to ensure that the suction hose 22 and the fluid delivery line 104 remain coupled to the base 12 while reducing rocking and twisting of the suction hose 22 and the fluid delivery line 104 relative to the base 12. Additionally, efficient cooling of the battery pack 56 and the PCBA 58 is enabled by the placement of the battery pack 56 and the PCBA 58 above the cooling fan 246 and adjacent to the air inlet 124 with the cooling space 260 that is disposed between multiple walls of the housing 14 and the battery pack 56 to largely surround the battery pack 56. Additional benefits and advantages may be realized and/or achieved.

The following Clauses provide example configurations of an extraction cleaner disclosed herein.

Clause 1. An extraction cleaner comprising: a base including: a housing having a first side wall and a second side wall opposite from the first side wall; a supply tank seat adjacent to the first side wall; a recovery tank seat adjacent to the second side wall; and a handle extending from the first side wall and the second side wall and above the housing; wherein the handle includes a grip portion, a first leg portion extending from the first side wall to the grip portion, and a second leg portion extending from the second side wall to the grip portion; a supply tank assembly configured to be received by the supply tank seat, with an inner wall of the supply tank assembly interfitting with the first side wall of the housing and with the first leg portion of the handle and extending along the first leg portion to the grip portion; and a recovery tank assembly configured to be received by the recovery tank seat, with an inner wall of the recovery tank assembly interfitting with the second side wall of the housing and with the second leg portion of the handle and extending along the second leg portion to the grip portion.

Clause 2. The extraction cleaner of clause 1, wherein: the inner wall of the supply tank assembly has a vertical channel extending from a bottom wall of the supply tank assembly to a top of the supply tank assembly and shaped to mate with the first side wall and with the first leg portion.

Clause 3. The extraction cleaner of any of clauses 1-2, wherein: the inner wall of the recovery tank assembly has a vertical channel extending from a bottom wall of the recovery tank assembly to a top of the recovery tank assembly and shaped to mate with the second side wall and with the second leg portion.

Clause 4. The extraction cleaner of clause 3, wherein the recovery tank assembly includes: a recovery tank defining the bottom wall of the recovery tank assembly; and a recovery tank lid removably couplable to the recovery tank; wherein the recovery tank lid is mounted to a top of the recovery tank opposite from the bottom wall of the recovery tank assembly; and wherein the vertical channel extends along both the recovery tank and the recovery tank lid.

Clause 5. The extraction cleaner of any of clauses 1-4, further comprising: a latching assembly operable to latch the recovery tank assembly to the base when the inner wall of the recovery tank assembly is interfit with the second side wall.

Clause 6. The extraction cleaner of clause 5, wherein: the handle includes a notch and the latching assembly includes a spring-biased latch at the notch; and a projection of the recovery tank assembly extends into the notch and is engaged by the spring-biased latch when the inner wall of the recovery tank assembly is interfit with the handle.

Clause 7. The extraction cleaner of clause 6, wherein: the inner wall of the recovery tank assembly has a vertical channel extending from a bottom wall of the recovery tank assembly to a top of the recovery tank assembly and shaped to mate with the second side wall and with the second leg portion; the recovery tank assembly includes a recovery tank defining the bottom wall of the recovery tank assembly and a recovery tank lid removably couplable to the recovery tank assembly; the recovery tank lid is mounted to a top of the recovery tank opposite from the bottom wall of the recovery tank assembly and the vertical channel extends along both the recovery tank and the recovery tank lid; and the projection extends from the recovery tank into the vertical channel of the recovery tank.

Clause 8. The extraction cleaner of any of clauses 6-7, wherein: the recovery tank assembly includes a protrusion at an exterior wall of the recovery tank assembly opposite from the inner wall; and the protrusion and the spring-biased latch are configured such that pulling the protrusion laterally outward away from the handle disengages the spring-biased latch from the projection of the recovery tank assembly.

Clause 9. The extraction cleaner of any of clauses 1-8, wherein the housing includes an internal cavity between the first side wall and the second side wall, and the extraction cleaner further comprises: a fluid pump disposed within the internal cavity; a suction source disposed within the internal cavity and operable to generate a working air stream; wherein the supply tank assembly fluidly couples with the fluid pump at the supply tank seat, and the recovery tank assembly fluidly couples with the working air stream at the recovery tank seat; and wherein the recovery tank seat is disposed lower than the supply tank seat and the internal cavity extends under the supply tank seat.

Clause 10. The extraction cleaner of any of clauses 1-9, wherein the handle does not extend laterally outward over the recovery tank assembly.

Clause 11. The extraction cleaner of any of clauses 1-10, wherein the handle does not extend laterally outward over the supply tank assembly.

Clause 12. The extraction cleaner of any of clauses 1-11, wherein the first leg portion of the handle interfitting with the inner wall of the supply tank assembly is vertical.

Clause 13. The extraction cleaner of any of clauses 1-12, wherein the second leg portion of the handle interfitting with the inner wall of the recovery tank assembly is vertical.

Clause 14. The extraction cleaner of any of clauses 1-13, wherein the first leg portion is narrower than the first side wall of the housing such that a portion of an inner wall of the supply tank assembly is exposed over the housing forward of the handle and rearward of the handle.

Clause 15. The extraction cleaner of any of clauses 1-14, wherein the second leg portion is narrower than the second side wall of the housing such that a portion of an inner wall of the recovery tank assembly is exposed over the housing forward of the handle and rearward of the handle.

Clause 16. An extraction cleaner comprising: a base including: a housing having a first side wall and a second side wall opposite from the first side wall; a supply tank seat adjacent to the first side wall; a recovery tank seat adjacent to the second side wall; and a handle extending from the first side wall and the second side wall and above the housing; a supply tank assembly configured to be received by the supply tank seat, with an inner wall of the supply tank assembly interfit with the first side wall of the housing and with the handle; a recovery tank assembly including a recovery tank configured to be received by the recovery tank seat, with an inner wall of the recovery tank assembly interfit with the first side wall of the housing and with the handle; wherein the recovery tank assembly includes a recovery tank lid on the recovery tank opposite from the recovery tank seat; wherein the handle does not extend laterally outward over the recovery tank lid; and a latching assembly operable to engage a feature at an inner wall of the recovery tank assembly to latch the recovery tank assembly to the base when the inner wall of the recovery tank assembly is interfit with the second side wall.

Clause 17. The extraction cleaner of clause 16, wherein: the base includes a notch; the latching assembly includes a spring-biased latch at the notch; and the feature at the inner wall of the recovery tank assembly is a projection that extends into the notch and is engaged by the spring-biased latch when the inner wall of the recovery tank assembly is interfit with the second side wall of the housing and with the handle.

Clause 18. The extraction cleaner of clause 17, wherein the notch is in the handle.

Clause 19. The extraction cleaner of any of clauses 17-18, wherein the recovery tank assembly has an exterior wall with a pull and the latching assembly is unlatched from the projection by pulling the recovery tank assembly laterally outward at the pull.

Clause 20. An extraction cleaner comprising: a base including a housing; a suction source within the housing operable to generate a working air stream; a fluid pump within the housing; a first coupling for fluid communication with the fluid pump and a second coupling for fluid communication with the suction source, the first coupling and the second coupling disposed adjacent to one another on the base; a suction hose having an inlet through which the working air stream is drawn through the suction hose and having an outlet configured to couple to the second coupling; a mount supported on and surrounding at least a portion of an outer wall of the suction hose adjacent to the outlet and at an opening in the outer wall; and a fluid delivery line configured to couple to the first coupling and routed through the mount and through the opening in the outer wall of the suction hose such that the fluid delivery line has a first portion extending through the mount to the opening and a second portion internal to the suction hose and extending between the opening and the inlet of the suction hose, the fluid delivery line thus spaced apart from the outlet of the suction hose.

Clause 21. The extraction cleaner of clause 20, wherein the housing includes a platform that extends under the mount and supports the mount.

Clause 22. The extraction cleaner of clause 21, wherein: the mount includes an inner mount portion secured to the base and an outer mount portion couplable to the inner mount portion and to the base; the platform or the inner mount portion has either a protruding rib or a recessed track, and the outer mount portion has the other of the protruding rib and the recessed track; and the protruding rib rests in the recessed track when the outer mount portion is coupled to the inner mount portion.

Clause 23. The extraction cleaner of clause 22, wherein: the platform or the inner mount portion has the recessed track and a lip; the outer mount portion has the protruding rib and a catch; and the catch engages the lip when the protruding rib rests in the recessed track.

Clause 24. The extraction cleaner of clause 23, wherein the lip has a ramped surface over which the catch slides when the catch engages the lip.

Clause 25. The extraction cleaner of any of clauses 20-24, wherein the base has a recess and an exterior surface of the mount is shaped to fit into the recess to limit movement of the mount relative to the base.

Clause 26. The extraction cleaner of clause 25, wherein: the base has a wall at the recess that is angled relative to a longitudinal center line of the second coupling; and the exterior surface of the mount defines a ramp that interfaces with the wall.

Clause 27. The extraction cleaner of any of clauses 20-26, further comprising: a latching assembly pivotably secured to the mount and operable to latch to the base.

Clause 28. The extraction cleaner of any of clauses 20-27, further comprising: a valve disposed within the housing at the first coupling and configured to open when the fluid delivery line couples to the first coupling, the open valve permitting fluid flow from the fluid pump through the fluid delivery line.

Clause 29. An extraction cleaner comprising: a base including a housing defining an internal cavity and having a first side wall, a second side wall opposite from the first side wall, a supply tank seat adjacent to the first side wall, a recovery tank seat adjacent to the second side wall, and a handle extending from the first side wall and the second side wall above a top wall of the housing; a motor and impeller assembly disposed within the internal cavity between the recovery tank seat and the supply tank seat and operable to generate a working air stream; a battery pack disposed within the housing above the motor and impeller assembly; a cooling fan disposed within the housing between the battery pack and the motor and impeller assembly and driven by the motor and impeller assembly; wherein the internal cavity includes a cooling space extending around the battery pack and between the battery pack and the housing; and wherein the housing has an air inlet adjacent to the battery pack through which ambient air is drawn into the cooling space by the cooling fan.

Clause 30. The extraction cleaner of clause 29, wherein: the housing includes a front wall extending downward from the top wall between the first side wall and the second side wall, and a rear wall extending downward from the top wall between the first side wall and the second side wall; and the cooling space extends between the first side wall and a first side of the battery pack, between the second side wall and a second side of the battery pack, between the front wall and a front of the battery pack, between the rear wall and a rear of the battery pack, and between the top wall and a top of the battery pack.

Clause 31. The extraction cleaner of clause 30, wherein at least a portion of one of the front wall and the rear wall extends parallel to a rotational axis of the cooling fan and the air inlet is in the portion of the one of the front wall and the rear wall that extends parallel to the rotational axis such that a flow path of ambient air pulled into the cooling space through the air inlet by the cooling fan is nonlinear.

Clause 32. The extraction cleaner of any of clauses 29-31, further comprising: a printed circuit board assembly within the housing above the battery pack and under the top wall of the housing.

Clause 33. The extraction cleaner of clause 32, further comprising: a user interface at an exterior of the base and operatively connected to the printed circuit board assembly.

Clause 34. The extraction cleaner of clause 33, wherein the user interface is at an exterior of a bottom portion of the handle. Clause 35. The extraction cleaner of clause 34, wherein at least a portion of the user interface is elevated above the exterior of the bottom portion of the handle.

Clause 36. The extraction cleaner of clause 34, wherein: the handle includes an inner ring portion that defines the bottom portion of the handle; and an interface between the inner ring portion and the housing at the bottom portion of the handle is at an inclined surface below the user interface to aid in prevention of water ingress at the user interface.

Clause 37. An extraction cleaner, comprising: a base including: a housing having a first side wall and a second side wall opposite from the first side wall; a supply tank seat adjacent to the first side wall; a recovery tank seat adjacent to the second side wall; and a handle extending from the first side wall and the second side wall and above the housing, wherein the handle includes a grip portion, a first leg portion extending from the first side wall to the grip portion, and a second leg portion extending from the second side wall to the grip portion; a supply tank assembly configured to be received by the supply tank seat and having an inner wall of the supply tank assembly interfitting with the first side wall of the housing and with the first leg portion of the handle, the supply tank assembly extending along the first leg portion to the grip portion; and a recovery tank assembly configured to be received by the recovery tank seat and having an inner wall of the recovery tank assembly interfitting with the second side wall of the housing and with the second leg portion of the handle, the recovery tank assembly extending along the second leg portion to the grip portion.

Clause 38. The extraction cleaner of clause 37, wherein the inner wall of the supply tank assembly defines a vertical channel extending from a bottom wall of the supply tank assembly to a top of the supply tank assembly and shaped to mate with the first side wall and with the first leg portion.

Clause 39. The extraction cleaner of either of clauses 37 or 38, wherein the inner wall of the recovery tank assembly has a vertical channel extending from a bottom wall of the recovery tank assembly to a top of the recovery tank assembly and shaped to mate with the second side wall and with the second leg portion.

Clause 40. The extraction cleaner of any one of clauses 37-39, wherein the housing includes an internal cavity between the first side wall and the second side wall, and the extraction cleaner further comprises: a fluid pump disposed within the internal cavity, wherein the supply tank assembly fluidly couples with the fluid pump at the supply tank seat; and a suction source disposed within the internal cavity and operable to generate a working air stream, wherein the recovery tank assembly fluidly couples with the working air stream at the recovery tank seat, and wherein the recovery tank seat is disposed lower than the supply tank seat and the internal cavity extends under the supply tank seat.

Clause 41. The extraction cleaner of any one of clauses 37-40, wherein the first leg portion of the handle interfitting with the inner wall of the supply tank assembly is vertical, and wherein the second leg portion of the handle interfitting with the inner wall of the recovery tank assembly is vertical.

Clause 42. The extraction cleaner of any one of clauses 37-41, further comprising: a latching assembly operable to latch the recovery tank assembly to the base when the inner wall of the recovery tank assembly is interfit with the second side wall.

Clause 43. The extraction cleaner of clause 42, wherein the handle includes a notch and the latching assembly includes a spring-biased latch at the notch, and wherein the recovery tank assembly includes a projection that extends into the notch and is engaged by the spring-biased latch when the inner wall of the recovery tank assembly is interfit with the handle.

Clause 44. An extraction cleaner, comprising: a base including: a housing having a first side wall defining a first protruding column and a second side wall defining a second protruding column; a handle coupled to a top of the housing, wherein the handle has a first leg portion extending from the first protruding column and a second leg portion extending from the second protruding column; a supply tank seat disposed adjacent to the first side wall; and a recovery tank seat adjacent to the second side wall; a supply tank assembly configured to be received by the supply tank seat, wherein the supply tank assembly defines a first inner channel configured to receive the first protruding column and the first leg portion when positioned on the supply tank seat; and a recovery tank assembly configured to be received by the recovery tank seat, wherein the recovery tank assembly defines a second inner channel configured to receive the second protruding column and the second leg portion when positioned on the recovery tank seat.

Clause 45. The extraction cleaner of clause 44, wherein the recovery tank assembly includes: a recovery tank defining a bottom wall of the recovery tank assembly; and a recovery tank lid removably couplable to the recovery tank, wherein the recovery tank lid is mounted to a top of the recovery tank opposite from the bottom wall, and wherein the second inner channel extends along both the recovery tank and the recovery tank lid.

Clause 46. The extraction cleaner of clause 45, wherein the recovery tank assembly has an inner wall defining the second inner channel, and wherein the second inner channel extends from the bottom wall of the recovery tank assembly to a top of the recovery tank lid and is shaped to mate with the second side wall and with the second leg portion.

Clause 47. The extraction cleaner of either of clauses 45 or 46, wherein the first leg portion is narrower than the first side wall of the housing such that a portion of an inner wall of the supply tank assembly is exposed over the housing on opposing sides of the handle.

Clause 48, The extraction cleaner of any one of clauses 45-47, wherein the second leg portion is narrower than the second side wall of the housing such that a portion of an inner wall of the recovery tank assembly is exposed over the housing on opposing sides of the handle.

Clause 49. The extraction cleaner of any one of clauses 45-48, wherein the supply tank assembly has a bottom wall, an inner wall defining the first inner channel, and a top opposite the bottom wall, the inner wall extending between the bottom wall and the top, and wherein the first inner channel extends from the bottom wall to the top to open upward at the top.

Clause 50. The extraction cleaner of any one of clauses 45-49, further comprising: a fluid pump disposed within the housing, wherein the supply tank assembly fluidly couples with the fluid pump at the supply tank seat; and a suction source disposed within the housing and operable to generate a working air stream, wherein the recovery tank assembly fluidly couples with the working air stream at the recovery tank seat.

Clause 51. A portable extraction cleaner, comprising: a base including: a housing have a first side wall and a second side wall; a supply tank seat disposed proximate the first side wall; a recovery tank seat disposed proximate the second side wall; and a handle coupled to the housing and extending between the supply tank seat and the recovery tank seat, wherein the handle has a first leg portion extending from the housing proximate the first side wall and a second leg portion extending from the housing proximate the second side wall; a supply tank assembly selectively disposed on the supply tank seat, wherein the supply tank assembly defines a first inner channel; and a recovery tank assembly selectively disposed on the recovery tank seat, wherein the recovery tank assembly defines a second inner channel, and wherein the first and second inner channels are configured to receive the first and second leg portions, respectively, of the handle.

Clause 52. The portable extraction cleaner of clause 51, wherein the recovery tank assembly includes a lid coupled to a top thereof, and wherein the recovery tank assembly is free of the handle extending laterally over the lid.

Clause 53. The portable extraction cleaner of either of clauses 50 or 51, the supply tank assembly is free of the handle extending laterally over a top thereof.

Clause 54. The portable extraction cleaner of any one of clauses 50-52, wherein the first side wall defines a protruding column configured to be received in the first inner channel, and wherein the second side wall defines a protruding column configured to be received in the second inner channel.

Clause 55. The portable extraction cleaner of any one of clauses 50-53, wherein the base includes a latching assembly, and wherein the recovery tank assembly includes a projection configured to be engaged by the latching assembly when an inner wall of the recovery tank assembly is interfit with the handle.

Clause 56. The portable extraction cleaner of clause 55, wherein the recovery tank assembly includes a pull feature at an exterior wall of the recovery tank assembly opposite from the inner wall, and wherein the pull feature and the latching assembly are configured such that pulling the pull feature laterally outward away from the handle disengages the latching assembly from the projection of the recovery tank assembly.

To assist and clarify the description of various embodiments, various terms are defined herein. Unless otherwise indicated, the following definitions apply throughout this specification (including the claims). Additionally, all references referred to are incorporated herein in their entirety.

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", "having", or any other variation thereof, are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

Further, for purposes of description herein, the terms "upper," "lower," "right," "left," "rear," "front," "vertical," "horizontal," and derivatives thereof, shall relate to the disclosure as oriented in FIG. 4. Unless stated otherwise, the term "front" shall refer to a surface closest to an intended viewer, and the term "rear" shall refer to a surface furthest from the intended viewer. However, it is to be understood that the disclosure may assume various alternative orientations, except where expressly specified to the contrary. It is also to be understood that the specific structures and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims. It will be understood by one having ordinary skill in the art that construction of the described disclosure and other components is not limited to any specific material. Other exemplary embodiments of the disclosure disclosed herein may be formed from a wide variety of materials, unless described otherwise herein.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

It is also important to note that the construction and arrangement of the elements of the disclosure, as shown in the exemplary embodiments, is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts, or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An extraction cleaner, comprising:

a base including:

a housing having a first side wall defining a first protruding column and a second side wall opposite from the first side wall and defining a second protruding column;

a handle extending from the first side wall and the second side wall and above the housing, wherein the handle includes a grip portion, a first leg portion extending from the first side wall to the grip portion, and a second leg portion extending from the second side wall to the grip portion and parallel with the first leg portion, wherein at least one of the first leg portion is narrower than the first side wall and the second leg portion is narrower than the second side wall;

a supply tank seat adjacent to the first side wall, wherein the first protruding column extends vertically along the first side wall from the supply tank seat to the first leg portion, and wherein the first leg portion extends from an end of the first protruding column to the grip portion; and a recovery tank seat adjacent to the second side wall, wherein the second protruding column extends vertically along the second side wall from the recovery tank seat to the second leg portion, and wherein the second leg portion extends from an end of the second protruding column to the grip portion;

a supply tank assembly configured to be received by the supply tank seat and having an inner wall of the supply tank assembly mating with the first side wall of the housing and with the first leg portion of the handle, the supply tank assembly configured to extend along the first leg portion to the grip portion; and a recovery tank assembly configured to be received by the recovery tank seat and having an inner wall of the recovery tank assembly mating with the second side wall of the housing and with the second leg portion of the handle, the recovery tank assembly configured to extend along the second leg portion to the grip portion, wherein the inner wall of the supply tank assembly defines a vertical channel extending from a bottom wall configured to be positioned on the supply tank seat to a top thereof to mate with the first leg portion and the first protruding column, and wherein the inner wall of the recovery tank assembly defines a vertical channel extending from a bottom wall configured to be positioned on the recovery tank seat to a top thereof to mate with the second leg portion and the second protruding column.

2. The extraction cleaner of claim 1, further comprising:

a fluid pump, wherein the housing includes an internal cavity between the first side wall and the second side wall and the fluid pump is disposed within the internal cavity, wherein the supply tank assembly fluidly couples with the fluid pump at the supply tank seat; and a suction source disposed within the internal cavity and operable to generate a working air stream, wherein the recovery tank assembly fluidly couples with the working air stream at the recovery tank seat, and wherein the recovery tank seat is disposed lower than the supply tank seat and the internal cavity extends under the supply tank seat.

3. The extraction cleaner of claim 1, wherein the first leg portion of the handle mating with the inner wall of the supply tank assembly is vertical, and wherein the second leg portion of the handle mating with the inner wall of the recovery tank assembly is vertical.

4. The extraction cleaner of claim 1, further comprising:

a latching assembly operable to latch the recovery tank assembly to the base when the inner wall of the recovery tank assembly is mated with the second side wall.

5. The extraction cleaner of claim 4, wherein the handle includes a notch and the latching assembly includes a spring-biased latch at the notch, and wherein the recovery tank assembly includes a projection that extends into the notch and is engaged by the spring-biased latch when the inner wall of the recovery tank assembly is mated with the handle.

6. The extraction cleaner of claim 4, wherein the recovery tank assembly includes a pull feature at an exterior wall of the recovery tank assembly opposite from the inner wall, and wherein the pull feature and the latching assembly are configured such that pulling the pull feature laterally outward away from the handle disengages the latching assembly from a projection of the recovery tank assembly.

7. The extraction cleaner of claim 1, wherein the recovery tank assembly includes:

a recovery tank defining the bottom wall of the recovery tank assembly; and a recovery tank lid removably couplable to the recovery tank, wherein the recovery tank lid is mounted to the top of the recovery tank, and wherein the vertical channel of the recovery tank assembly extends along both the recovery tank and the recovery tank lid.

8. The extraction cleaner of claim 7, wherein the recovery tank assembly is free of the handle extending laterally over the recovery tank lid such that the recovery tank assembly is configured to be lifted from the recovery tank seat with the vertical channel of the recovery tank assembly sliding past the second leg portion.

9. The extraction cleaner of claim 1, wherein the first leg portion is narrower than the first side wall of the housing such that a portion of the inner wall of the supply tank assembly is exposed over the housing on opposing sides of the handle.

10. The extraction cleaner of claim 1, wherein the second leg portion is narrower than the second side wall of the housing such that a portion of the inner wall of the recovery tank assembly is exposed over the housing on opposing sides of the handle.

11. The extraction cleaner of claim 1, wherein the supply tank assembly is free of the handle extending laterally over the top thereof such that the supply tank assembly is configured to be lifted from the supply tank seat with the vertical channel of the supply tank assembly sliding past the first leg portion.

12. The extraction cleaner of claim 1, wherein the supply tank assembly extends along the first leg portion to be laterally adjacent to the grip portion.

13. The extraction cleaner of claim 1, wherein the recovery tank assembly extends along the second leg portion to be laterally adjacent to the grip portion.

14. The extraction cleaner of claim 1, wherein an opening is defined by the grip portion and the first and second leg portions, and wherein the opening is disposed between the recovery tank assembly and the supply tank assembly.

15. The extraction cleaner of claim 1, wherein the supply tank assembly is disposed adjacent to the handle such that the supply tank assembly is free of being directly under the first leg portion when the supply tank assembly is seated at the supply tank seat.

16. The extraction cleaner of claim 1, wherein the recovery tank assembly is adjacent to the handle such that the recovery tank assembly is free of being directly under the second leg portion when the recovery tank assembly is seated at the recovery tank seat.

17. The extraction cleaner of claim 1, wherein the first leg portion is continuous from the first protruding column, and wherein the second leg portion is continuous from the second protruding column.

18. The extraction cleaner of claim 1, wherein the first leg portion defines a same width as the first protruding column to each be received by the vertical channel of the supply tank assembly, and wherein the second leg portion defines a same width as the second protruding column to each be received by the vertical channel of the recovery tank assembly.

19. The extraction cleaner of claim 1, wherein the first leg portion is vertical and protrudes laterally further than the first protruding column to fill the vertical channel of the supply tank assembly, a gap being defined in a portion of the vertical channel of the supply tank assembly between the supply tank assembly and the first protruding column, and wherein the second leg portion is vertical and protrudes laterally further than the second protruding column to fill the vertical channel of the recovery tank assembly, a gap being defined in a portion of the vertical channel of the recovery tank assembly between the recovery tank assembly and the second protruding column.

* * * * *